US007971408B2

(12) United States Patent
Hayes, Sr.

(10) Patent No.: US 7,971,408 B2
(45) Date of Patent: Jul. 5, 2011

(54) STAIRTOWER AND METHOD FOR ERECTING THE SAME

(76) Inventor: Richard Hayes, Sr., Staten Island, NY (US)

( * ) Notice: Subject to any disclaimer, the term of this patent is extended or adjusted under 35 U.S.C. 154(b) by 916 days.

(21) Appl. No.: 11/889,378

(22) Filed: Aug. 13, 2007

(65) Prior Publication Data

US 2008/0017448 A1 Jan. 24, 2008

Related U.S. Application Data

(63) Continuation-in-part of application No. 10/854,138, filed on May 27, 2004, now Pat. No. 7,258,199.

(51) Int. Cl.
*E04H 12/00* (2006.01)

(52) U.S. Cl. ..... 52/651.1; 52/143; 52/185; 52/651.01

(58) Field of Classification Search ..... 52/143, 52/648.1, 650.3, 651.01, 651.05, 651.06, 52/651.1, 185; 182/178.1, 222, 223, 42; 414/631, 632, 633, 634, 641
See application file for complete search history.

(56) References Cited

U.S. PATENT DOCUMENTS

| | | | | |
|---|---|---|---|---|
| 2,438,173 | A | 3/1948 | Johnson et al. | |
| 2,485,165 | A * | 10/1949 | Pollman | 182/223 |
| 3,221,837 | A | 12/1965 | Fisher | |
| 3,228,154 | A * | 1/1966 | Mulitz | 52/185 |
| 3,305,046 | A | 2/1967 | Schar | |
| 3,454,131 | A * | 7/1969 | Johnson et al. | 182/115 |
| 3,565,212 | A | 2/1971 | Johnson | |
| 3,697,098 | A * | 10/1972 | Fisher | 280/415.1 |
| 3,768,016 | A | 10/1973 | Townsend et al. | |
| 3,788,018 | A | 1/1974 | Simmons et al. | |
| 3,859,771 | A | 1/1975 | Simmons et al. | |
| 3,901,532 | A | 8/1975 | Hornagold | |
| 4,084,777 | A | 4/1978 | Lambert | |
| 4,253,549 | A | 3/1981 | Petren | |
| 4,397,373 | A | 8/1983 | Ream et al. | |
| 4,621,972 | A * | 11/1986 | Grotte | 414/477 |

(Continued)

FOREIGN PATENT DOCUMENTS

EP 0 713 942 A1 5/1996

(Continued)

OTHER PUBLICATIONS

Occupational Safety and Health Administration, A Guide to Scaffold Use in the Constructions Industry, Small Business Safety Management Series, OSHA 3150 2002 (Revised).

(Continued)

*Primary Examiner* — Eileen Lillis
*Assistant Examiner* — Branon C Painter
(74) *Attorney, Agent, or Firm* — Bacon & Thomas, PLLC

(57) ABSTRACT

A transportable and erectable stairtower having a removable/slidable wheel carriage and a removable installation section arranged for transporting and erecting the stairtower. The stairtower has vertical column members and lateral members defining levels of the stairtower. Removable staircases extend between alternate levels of lateral members. A platform landing is formed at the intersection of first and second stair segments of the staircase. Removable ramps may be connected to the stairtower above, below, and at a position corresponding to the platform landings. A safety device in the form of catch pans, gutters, and leaders may be provided to protect workers by collecting debris and rainwater. A transporting vehicle may be connected to the installation section to transport the stairtower to a desired location. A lifting vehicle may be used to lift the stairtower from a horizontal to a vertical orientation.

18 Claims, 23 Drawing Sheets

U.S. PATENT DOCUMENTS

| | | | | |
|---|---|---|---|---|
| 4,707,957 | A | 11/1987 | Sheppherd | |
| 4,759,162 | A | 7/1988 | Wyse | |
| 4,773,506 | A | 9/1988 | Preston | |
| 4,825,192 | A | 4/1989 | Wells | |
| 4,858,726 | A | 8/1989 | Preston | |
| 4,930,273 | A | 6/1990 | Papesch | |
| 4,967,875 | A | 11/1990 | Beeche | |
| 5,127,492 | A | 7/1992 | Preston | |
| 5,156,235 | A | 10/1992 | Preston | |
| 5,335,468 | A | 8/1994 | Oberman et al. | |
| 5,491,939 | A | 2/1996 | Wang | |
| 5,617,931 | A | 4/1997 | Zygmun et al. | |
| 6,257,272 | B1 * | 7/2001 | Keiser | 137/343 |
| 6,415,891 | B1 | 7/2002 | Hayman et al. | |
| 6,464,196 | B1 | 10/2002 | Crookham et al. | |
| 6,539,571 | B1 | 4/2003 | Forsyth | |
| 6,648,102 | B2 | 11/2003 | Bostelman et al. | |
| 2003/0150187 | A1 | 8/2003 | Forsyth et al. | |
| 2003/0178253 | A1 | 9/2003 | Tatge et al. | |

FOREIGN PATENT DOCUMENTS

| | | | |
|---|---|---|---|
| GB | 368436 | A | 3/1932 |
| JP | 7-197618 | | 8/1995 |
| JP | 10-037309 | | 2/1998 |
| JP | 2002-38718 | | 2/2002 |
| KR | 10-2006-0133289 | | 12/2006 |
| WO | WO 00/37753 | A | 6/2000 |

OTHER PUBLICATIONS

Construction Equipment, Market Watch Lite, Oct. 2006, p. 100.

* cited by examiner

FIG. 15
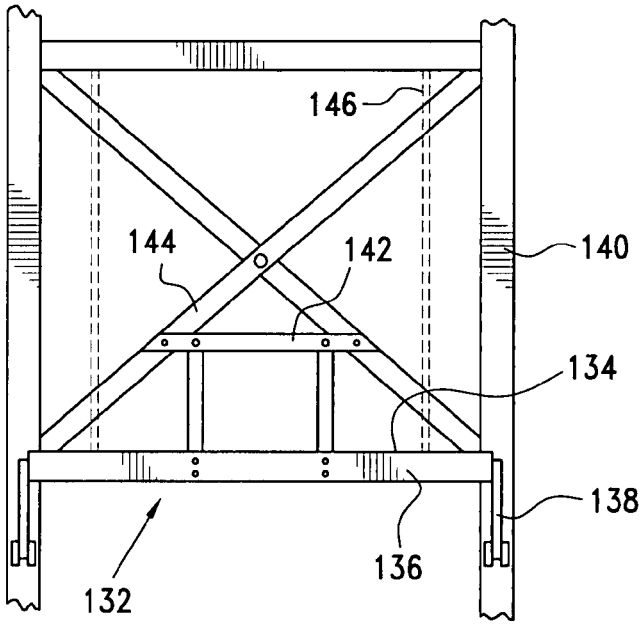
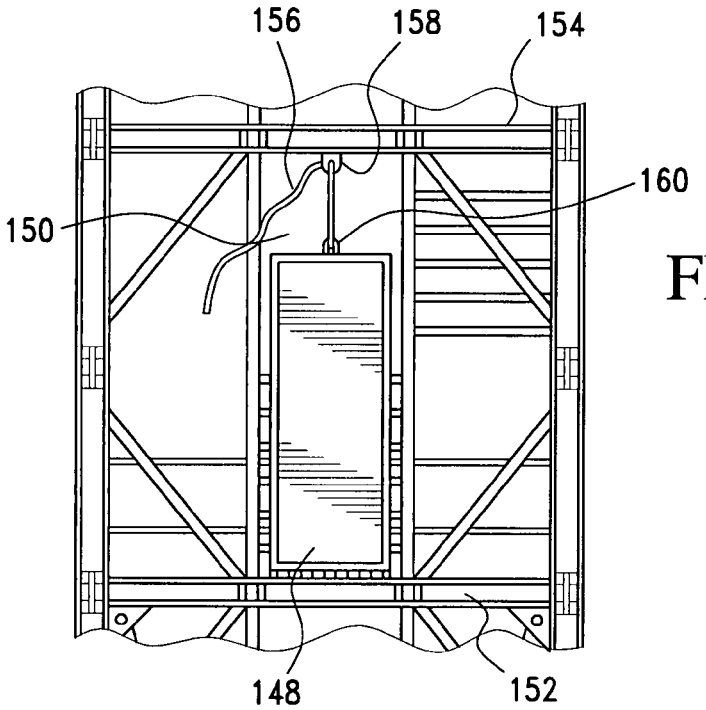
FIG. 16
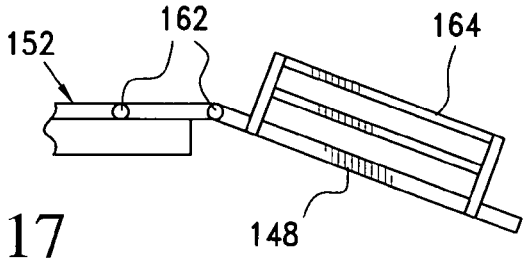
FIG. 17

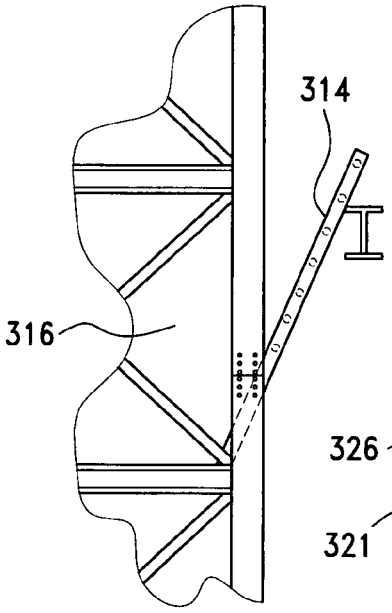
FIG. 27
FIG. 28
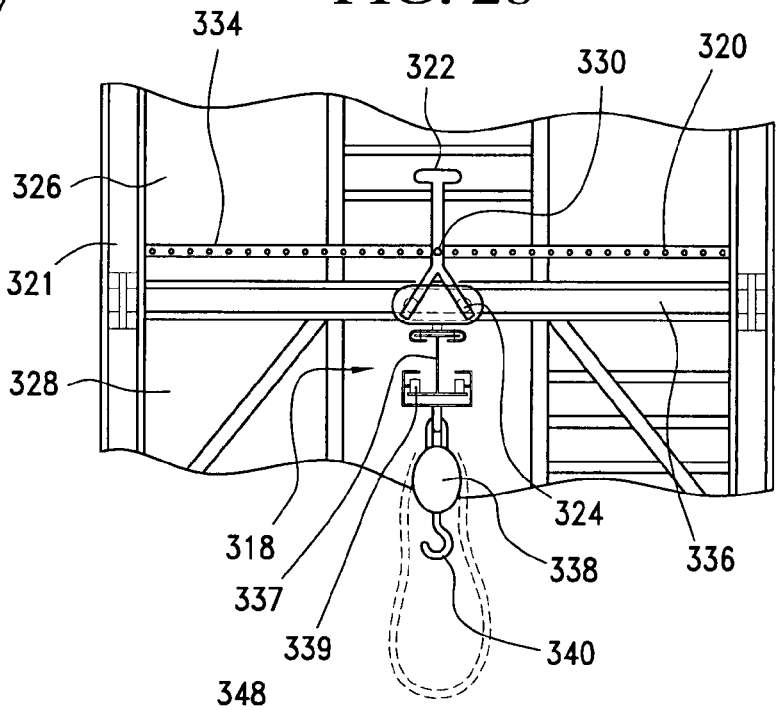
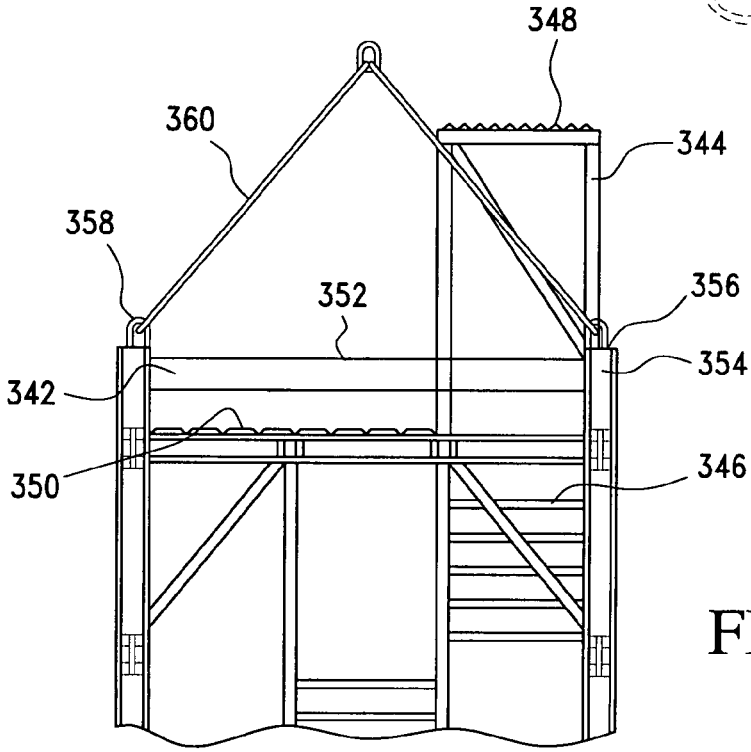
FIG. 29

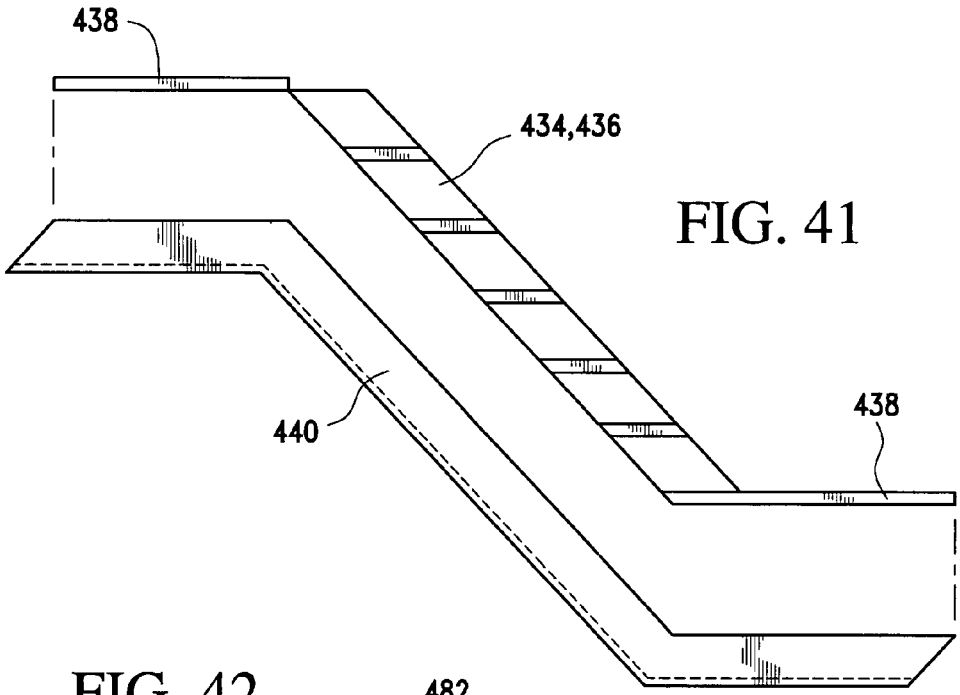
FIG. 41
FIG. 42
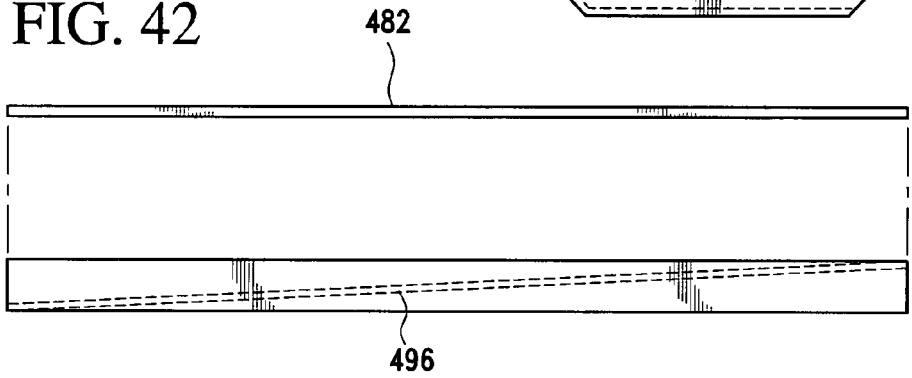
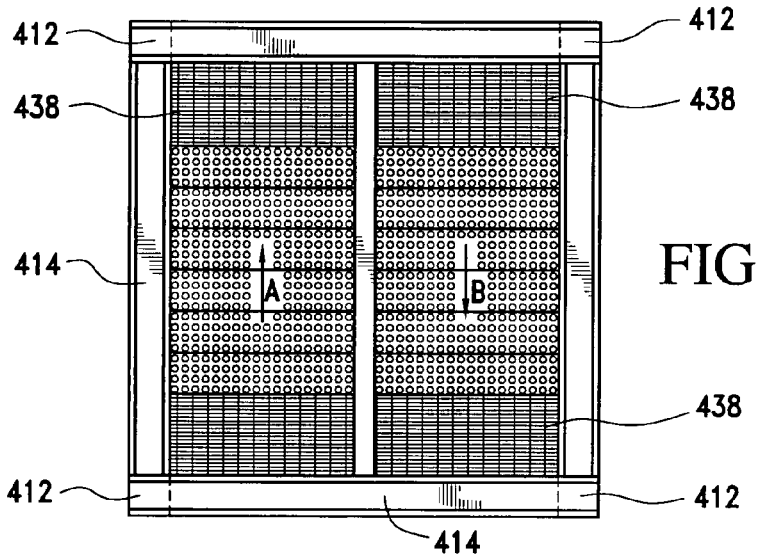
FIG. 43

STAIRTOWER AND METHOD FOR ERECTING THE SAME

This application is a continuation-in-part of prior U.S. patent application Ser. No. 10/854,138, filed May 27, 2004.

BACKGROUND

Conventional ladders and scaffolding for use in building construction have many inherent problems, the most prominent thereof being that they are a major source of injuries among construction workers. Injuries may occur from the slightest of worker tasks such as transportation of small tools, material and food between levels of building construction. Workers commonly suffer injuries such as back strain, ankle strain, and bruises when ascending and descending ladders, or transporting items via pulleys and other conveying devices. In addition, there is seldom any protection from and for falling debris, and workers are therefore exposed to risk of injury from such debris. Moreover, ladders do not restrain a worker in the event of a fall, and known scaffolding has limitations in also restraining fallen workers.

A drawback to scaffolding is that it may be labor intensive to erect, and may not provide sufficient coordination to meet height requirements of a high rise building. The limitations of erecting ladders in building construction are self-apparent in that they are limited in height and must be stabilized. Providing additional levels or moving the scaffolding at or to different building constructions may prove cumbersome and time consuming, and moreover the scaffolding may not possess sufficient structural strength and stability to execute certain construction operations or support construction tools and many workers.

Productivity losses are inherent in building construction using ladders and scaffolding. Losses may occur due to the time and effort required to transport goods between building levels. Moreover, due to the lack of stability and nature of ladders, workers must ascend and descend levels of the building construction with the utmost care. Typically, ladders are used in scaffolding and thus the drawbacks of ladders are also present in most known scaffolding systems. Productivity losses also occur due to poor organization of utility access between levels, such as in receiving supplies of electricity, compressed air, oxygen, gas and water. Such utility access is rarely centralized and is instead scattered at numerous and random locations.

For the foregoing reasons, there is need for an access stairtower that overcomes the attendant drawbacks and disadvantages of known ladders and scaffolding systems in providing a safe, productivity increasing, easily erectable, portable and installable access stairtower assembly.

SUMMARY

The present invention is directed to a stairtower that satisfies the needs of providing a safe, productivity increasing, and easily transportable, erectable, and installable access stairtower assembly. In an embodiment of the multilevel access platform, the platform includes a plurality of platform modules wherein each includes elongate and coextensive column members that are generally coextensive and parallel to each other, and a plurality of levels of elongate lateral members that extend transversely between and are connected to the column members. The levels of the lateral members are located at vertically spaced positions relative to the column members and each of the lateral members borders a side of the module.

In yet another embodiment of the stairtower, the staircase extends between alternating levels of lateral members, a wheel carriage is arranged for connection along a side of the stairtower, and a removable installation section is connected to the distal ends of the column members and arranged for transporting and erecting the stairtower. The installation section includes a frame of opposed lateral members and opposed projecting and angle members with cross pieces extending across the opposed members. One cross-piece has a projection for receiving a first hitch. Another cross-piece includes a second hitch extending therefrom. Yet another cross-piece forms a vertical lifting point for lifting the stairtower from a horizontal to a vertical orientation. Appropriate brake, headlight, and turn signal indicators may be provided at suitable locations on the stairtower.

In an alternate configuration, a distal end of the wheel carriage is slidably connected to the stairtower and a proximal end of the wheel carriage is pivotally connected to the stairtower such that the wheels of the wheel carriage do not block the passage of persons up and down the staircases of the stairtower when the stair tower is in a vertical orientations.

In another variation, a distal end and a proximal end of the wheel carriage are removably connected to the stairtower. The wheel carriage may also be removably connectable to the stairtower at selected positions along the side of the stairtower.

In an alternate configuration, the staircase is formed of first and second stair segments which are independently removably attached to the stairtower. The first and second stair segments each include a first landing portion, a stair segment, and a second landing portion. When the first and second stair segments are placed into the stairtower, the juxtaposed first and second landing portions of the first and second stair segments, respectively, form a platform landing.

A ramp may be removably pivotally connected to a column member at select positions above, below, and corresponding with the level of the platform landing. The ramp may include steps progressing from the platform landing to a base of the ramp, and safety rigging, such as safety cables or hand rails, along opposed sides of the ramp. In a variation, a portion of the lateral members positioned opposite to the platform landing are removable to define at least one portal to allow passage between the interior and the exterior of the stairtower. A plurality of outriggers may be positioned about the periphery of each level of lateral members in areas surrounding the at least one portal.

In a variation, the first landing portion, the stair portion, and the second landing portion of each stair segment have perforations, such as holes or grating, to allow the passage of debris or rainwater therethrough. Catch pan segments are connected to proximal portions of the first landing portion, the stair portion, and the second landing portion of each stair segment to collect and transport debris and rainwater to gutters and leaders connected to the stairtower.

A method of transporting and erecting a stairtower having structures as described above includes providing the stairtower in a horizontal orientation, connecting a vehicle to the removable installation section and transporting the stairtower to a desired location. Once at the desired location, the vehicle is disconnected from the stairtower and an operative portion of a lifting device is connected to the removable installation section and the stairtower is lifted to a vertical orientation.

In a variation, the method includes transporting the stairtower with the staircase removed therefrom and connecting the staircase to the stairtower. This may be done either prior to or after the stairtower is lifted to the vertical orientation. The removable transporting and erecting section is also removed after the stairtower is lifted to the vertical orientation.

In a further variation, appropriate brake, headlight, and turn signal indicators are connected to the stairtower prior to transporting the stairtower, and are removed prior to lifting the stairtower to a vertical orientation.

BRIEF DESCRIPTION OF THE DRAWINGS

These and other features, aspects, and advantages of the present invention will become better understood with regard to the following description, appended claims, and accompanying drawings where:

FIG. 15 is a frontal elevational view showing another embodiment of an outrigger assembly;

FIG. 16 is a frontal elevational view showing an embodiment of a ramp;

FIG. 17 is a side elevational view showing the ramp of FIG. 15;

FIG. 27 is an elevational sectional view showing an embodiment of a ladder connected to a level of the inventive stairtower;

FIG. 28 is an elevational sectional view showing an embodiment of a trolley connected between two levels of the inventive stairtower;

FIG. 29 is an elevational sectional view showing an embodiment of a top level of the inventive stairtower.

FIGS. 41 and 42 are exploded views of the stair segments and ramp platforms detailing the catch pans of the inventive stairtower.

FIG. 43 is a top down view of an example of the interior structure of the inventive stair tower.

Figure 1:
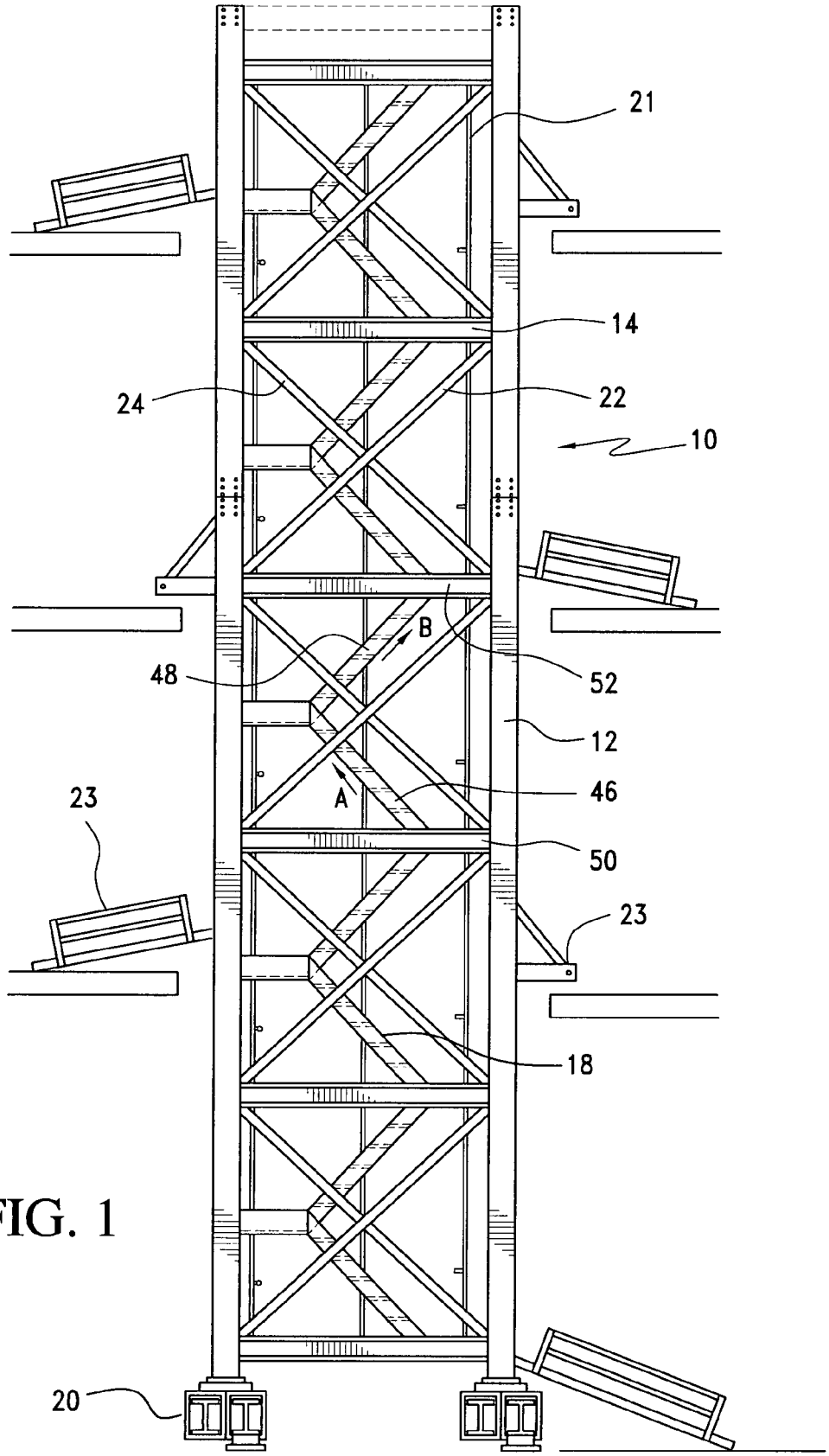
FIG. 1 is an elevational view of one side of a multilevel access stairtower embodying features of the inventive stairtower.

It should be noted that the drawing figures are not necessarily drawn to scale, but instead are drawn to provide a better understanding of the components thereof, and are not intended to be limiting in scope, but rather provide exemplary illustrations.

DETAILED DESCRIPTION OF VARIOUS EMBODIMENTS

A. Overview

A better understanding of different embodiments of the invention may be had from the following description read in conjunction with the accompanying drawings in which like reference characters refer to like elements.

While the disclosure is susceptible to various modifications and alternative constructions, certain illustrative embodiments thereof are shown in the drawings and will be described below in detail. It should be understood, however, that there is no intention to limit the disclosure to the specific embodiments disclosed, but on the contrary, the intention is to cover all modifications, alternative constructions, combinations, and equivalents falling within the spirit and scope of the disclosure and defined by the appended claims.

It will be understood that, unless a term is expressly defined in this patent to possess a described meaning, there is no intent to limit the meaning of such term, either expressly or indirectly, beyond its plain or ordinary meaning. As used herein, the term "proximal" has its ordinary meaning and refers to a location that is closer to a reference point than another location. Likewise, the term "distal" has its ordinary meaning and refers to a location that is further from the reference point than another location.

Any element in a claim that does not explicitly state "means for" performing a specified function, or "step for" performing a specific function, is not to be interpreted as a "means" or "step" clause as specified in 35 U.S.C. §112, paragraph 6.

B. Environment and Context of Embodiments

Embodiments of the invention are discussed in the context of a transportable multilevel access stairtower that may be used in the erection of a building construction having a plurality of superimposed floor levels. The stairtower may be horizontally transported to a construction site and may be lifted to a vertical position on site. The stairtower may be transported in a fully assembled configuration, or may be transported in a partially assembled configuration. The stairtower may be inserted into a building shaft prior to completion of such building, and may be subsequently disassembled or withdrawn from the building when usage thereof is deemed complete. The stairtower may be installed in the building shaft fully assembled, or may be erected outside or in the shaft.

The environment and context of the embodiments of the invention are also with respect to use of the stairtower for a construction site or similar setting. The stairtower may therefore be adapted to the range of environmental conditions that may exist at any construction location, and configured for withstanding the normal activities associated with building construction.

It is to be understood that other analogous uses of the stairtower according to the nature of the embodiments described herein are possible. It is also to be understood that other uses for supporting structures are possible with and without the base assembly to be discussed below.

C. Various Embodiments of the Stairtower

Figure 2:
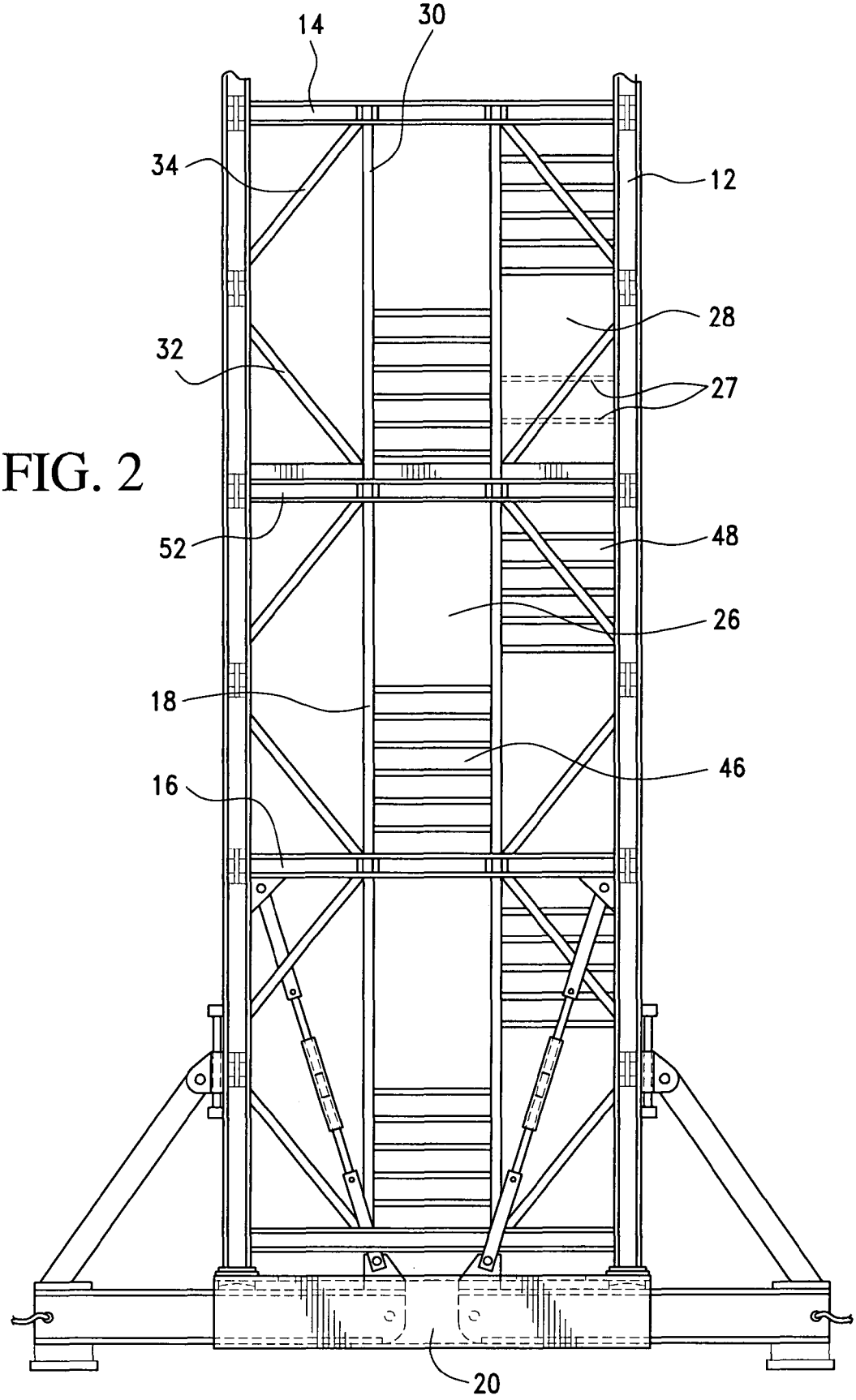
FIG. 2 is an elevational view of another side of the multilevel access stairtower according to FIG. 1.

FIGS. 1 and 2 illustrate an embodiment of a multilevel access stairtower 10 according to the invention. The stairtower 10 includes elongate column members 12 that are generally parallel and coextensive, and levels of elongate lateral members 14 extending transversely between and connected to the column members 12. Each level of the stairtower 10 is located at a vertically spaced position along the column members 12. Each of the lateral members 14 borders a side of the stairtower 10, and a plurality of platform sections 16 are supported by the lateral members 14 at corresponding levels. A staircase 18 extends between each level of the lateral members 14 and connects each of the levels. A base assembly 20 is connected to a lower end (or base) of the column members 12 and is arranged for supporting the stairtower 10.

Suitable utility access conduits 21 may be provided for each level of the stairtower 10, such utility access conduits 21 including means for electricity, gas, oxygen, and compressed air. Welding machine generators can similarly be attached or placed on levels of the platform, and appropriate lighting may be provided above each platform level and staircase 18.

Loading devices 23 such as ramps and pulleys may be pivotally connected to platform levels to facilitate access to and from the stairtower 10. Moreover, safety devices 25, such as extending outriggers pivotally connected to the stairtower, may be provided for each platform level.

As shown in FIG. 1, two diagonal members 22, 24 extend between and are connected to two sets of adjacent lateral members 14 on opposed sides of the stairtower 10. Conversely, FIG. 2 shows portals 26 defined between the levels of the lateral members 14 which are located on sides of the stairtower 10 in this embodiment which are adjacent to the sides having the diagonal members 22, 24.

Each portal 26 is defined by mutually opposed web members 28. Each web member 28 includes a first leg 30 extending between opposed levels of lateral members 14 and generally parallel with the column members 12. The web member also includes second and third legs 32, 34 which are inclined in orientation to the first leg 30 and extend diagonally from adjacent ends of the first leg 30 to one of the column members 12. Appropriate safety cables 27, as is consonant with embodiments of the stairtower, may be provided at each web member 28.

The portals 26 provide access to levels of the stairtower and generally correspond to floors of the building construction, while the diagonal members 22, 24 and the web members 28 provide support to the stairtower by reinforcing its structure and moreover, prevent access to the stairtower at adjacent regions thereof. It will be understood that it is considered to be clearly within the scope of the invention to provide portals of any height, width, or number.

Figure 3:
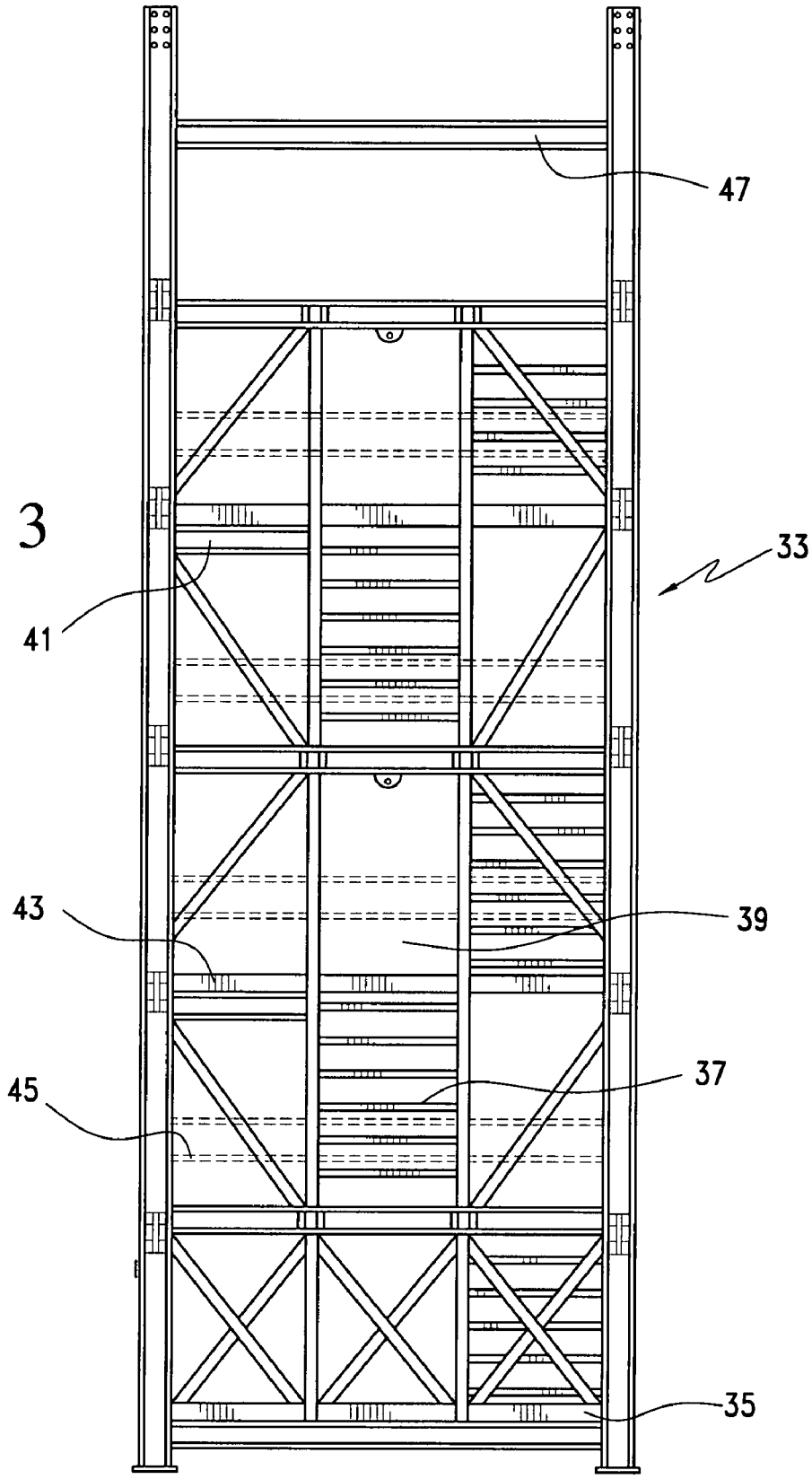
FIG. 3 is an elevational view of an embodiment of a structural configuration of a multilevel access stairtower.

Turning to FIG. 3, an embodiment of a half-tier stairtower assembly 33 is shown, wherein the assembly 33 has access to half-tier portions thereof. For example, the assembly 33 includes half-tier level 35 and full tier levels 39 with staircase 37 extending therebetween. Platform beams 41 with an appropriate toe-kick 43 are provided between each stairtower level 39. Appropriate safety cables 45, as is consonant with embodiments of the invention, may be provided at each half-tier of the assembly 33. A spacer beam 47 may be provided to reinforce the assembly 33 or to provide a means for transporting the assembly 33.

Figure 4:
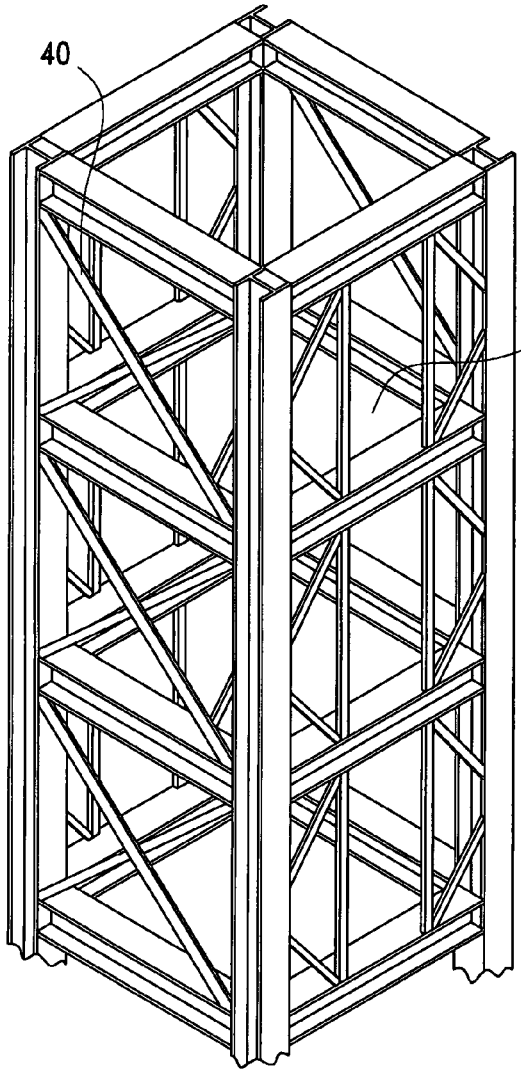
FIG. 4 is perspective view of another embodiment of a structural configuration of a multilevel access stairtower.
Figure 5:
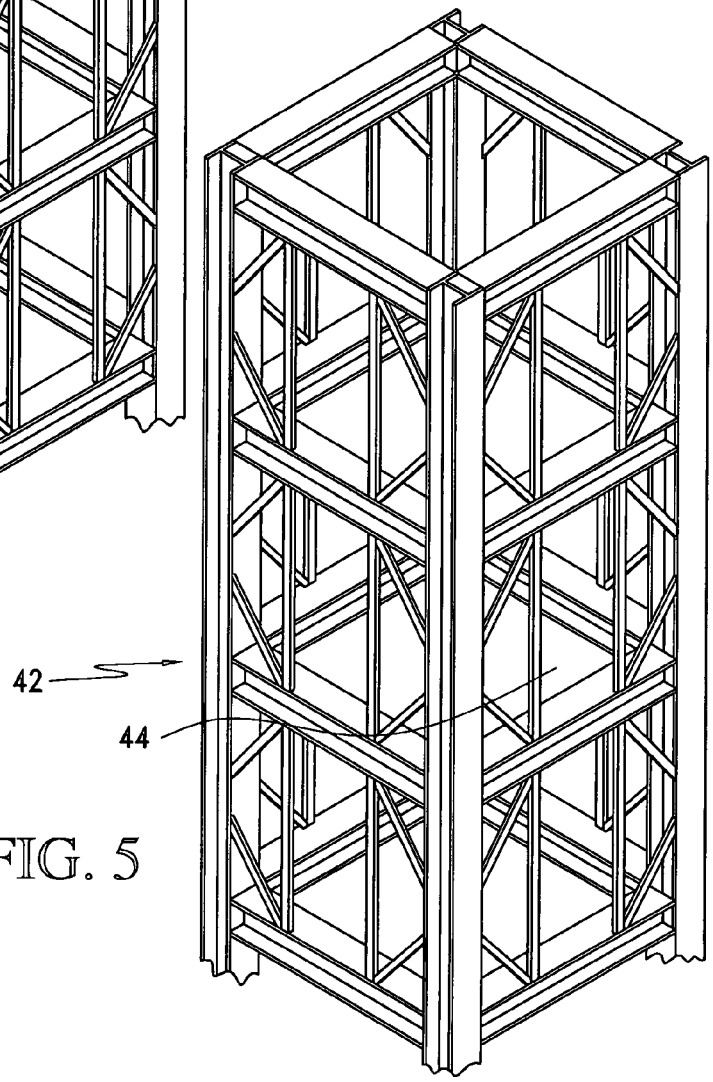
FIG. 5 is a perspective view of another embodiment of a structural configuration of a multilevel access stairtower.

As shown in FIGS. 4 and 5, portions of a basic structure of the stairtower may be arranged with different portal locations. For example, in the embodiment illustrated in FIG. 4 and similar to the embodiment shown in FIGS. 1 and 2, a basic stairtower structure 36 defines portals 38 on opposed sides, whereas sides adjacent the portals are reinforced with diagonal structural members 40. On the other hand, FIG. 5 shows a basic stairtower structure defining a portal 44 on each side thereof. Of course, it will be understood that it is within the scope of the invention to define portals on only one side of a basic stairtower structure, or in the alternative, levels having different numbers of portals.

Returning to the embodiment shown in FIGS. 1 and 2, the staircase 18 is configured to extend between each level of the lateral members 14. Between each level of the lateral members 14, the staircase 18 includes first and second stair segments 46, 48 of generally identical construction and disposed adjacently in generally parallel vertical planes. The first stair segment 46 connects to a lower (or first) level of lateral members 50 and extends about halfway between the lower level of lateral members 50 and an upper (or second) level of lateral members 52 in a first inclined direction A. The first and second stair segments 46, 48 join halfway between the upper and lower levels 50, 52 of lateral members to define an intermediate landing 54. The second stair segment 48 extends from the first stair segment 46 in a second inclined direction B towards the second level 52 of lateral members.

Figure 7:
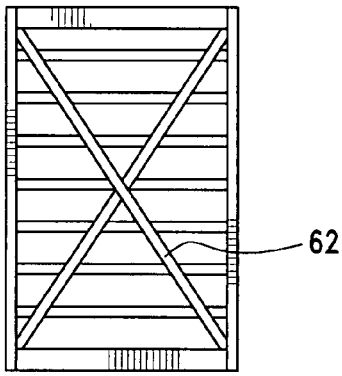
FIG. 7 is a bottom plan view of the stair segment in FIG. 6.
Figure 6:
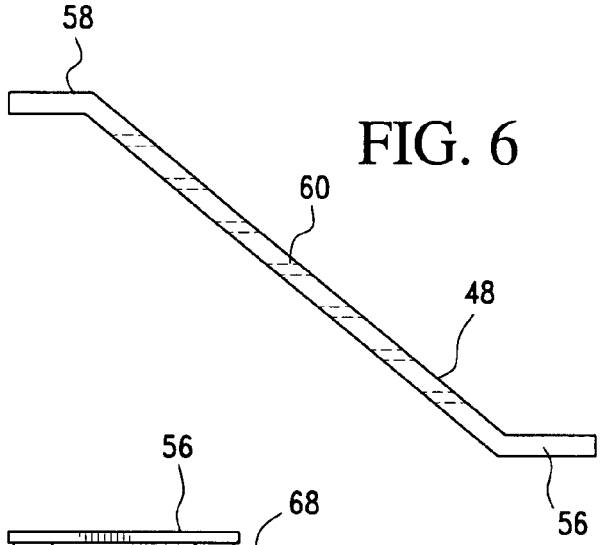
FIG. 6 is an elevational view showing an embodiment of a stair segment of the stairtower of FIG. 1.
Figure 8:
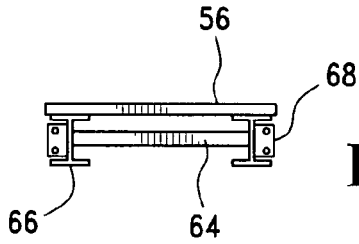
FIG. 8 is an elevational, schematic view showing the stair segment of FIG. 6 mounted on the stairtower of FIG. 1.

In FIGS. 6-8 an exemplary construction of the staircase 18 is shown. FIG. 6 shows the basic construction of stair segment 46, whereby stair segment 46 is interchangeable with stair segment 48 shown in FIGS. 1 and 2. Stair segment 46 includes first and second landing portions 56, 58 defined at end portions thereof, and defines a plurality of steps 60. FIG. 7 illustrates an embodiment of the stair segment 48 being reinforced with support members 62 that are positioned underneath stair segment 48.

FIG. 8 illustrates the first landing portion 56 as being secured to the stairtower by an angle brace 64 that extends underneath thereof and spans opposed support members 66. The angle brace 64 is connected to the support members 66 by suitable fasteners 68. The support members 66 may be I-beams or other suitable structural members provided for retaining the staircase under normal operating conditions which would be understandable to a skilled artisan. Similarly, the angle brace 64 may be selected from a variety of materials and configurations sufficient to reinforce the connection of the staircase to the platform.

Figure 9:
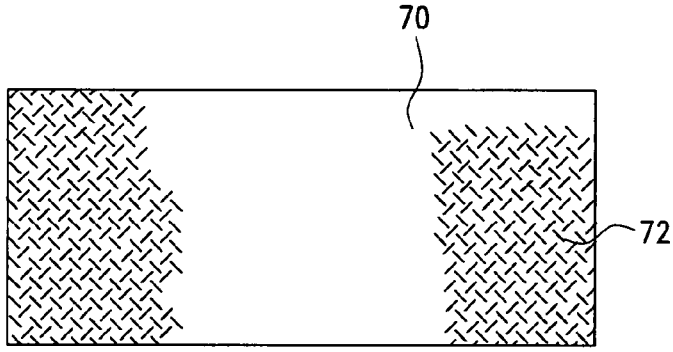
FIG. 9 is an elevational view showing an embodiment of a platform section in the stairtower of FIG. 1.
Figure 10:
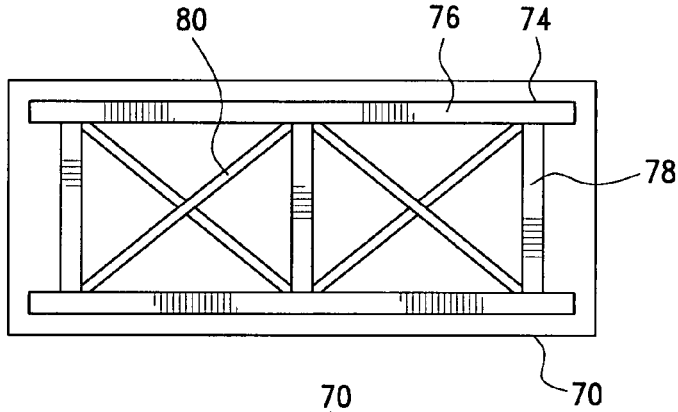
FIG. 10 is a bottom plan view of the platform section in FIG. 6.
Figure 11:
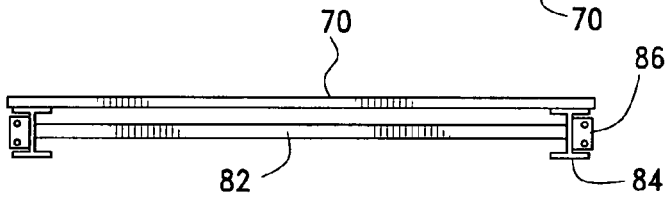
FIG. 11 is a schematic elevational view showing the platform section of FIG. 9 mounted on the stairtower of FIG. 1.

FIGS. 9-11 illustrate an embodiment of the aforementioned platform sections 16 described herein in connection to FIGS. 1 and 2. More specifically, the platform section 70 shown in FIG. 9 comprises a generally flat and rectilinear plate. The platform section 70 has a textured or perforated surface 72 that may be constructed of expanded metal, perforated metal, bar grating, fiberglass grating, hex metal and other suitable stairtower or decking materials or configurations.

In FIG. 10, an embodiment of a reinforcement structure 74 for each platform section 70 is shown. The reinforcement structure 74 is generally intended to be positioned underneath the platform section 70 and includes a plurality of longitudinal members 76 connected to a series of transverse members 78. A plurality of reinforcing diagonal members 80 span distances between the longitudinal members 76 and transverse members 78, and serve to improve the structural integrity of the reinforcement structure 74.

Similar to the configuration discussed above in connection with FIG. 8 regarding securing the stair segments to the platform, FIG. 11 illustrates that the platform section 70 may be secured to the stairtower by an angle brace 82 that extends underneath thereof and spans opposed support members 84. The angle brace 82 is connected to the support members 84 by suitable fasteners 86. The support members 84 may be I-beams or other suitable structural members provided for retaining and securing the platform section against the stairtower understandable to a skilled artisan. Similarly, the angle brace 82 may be selected from a variety of materials and configurations sufficient to reinforce the connection of the platform section to the stairtower.

Figures 12, 13, 14:
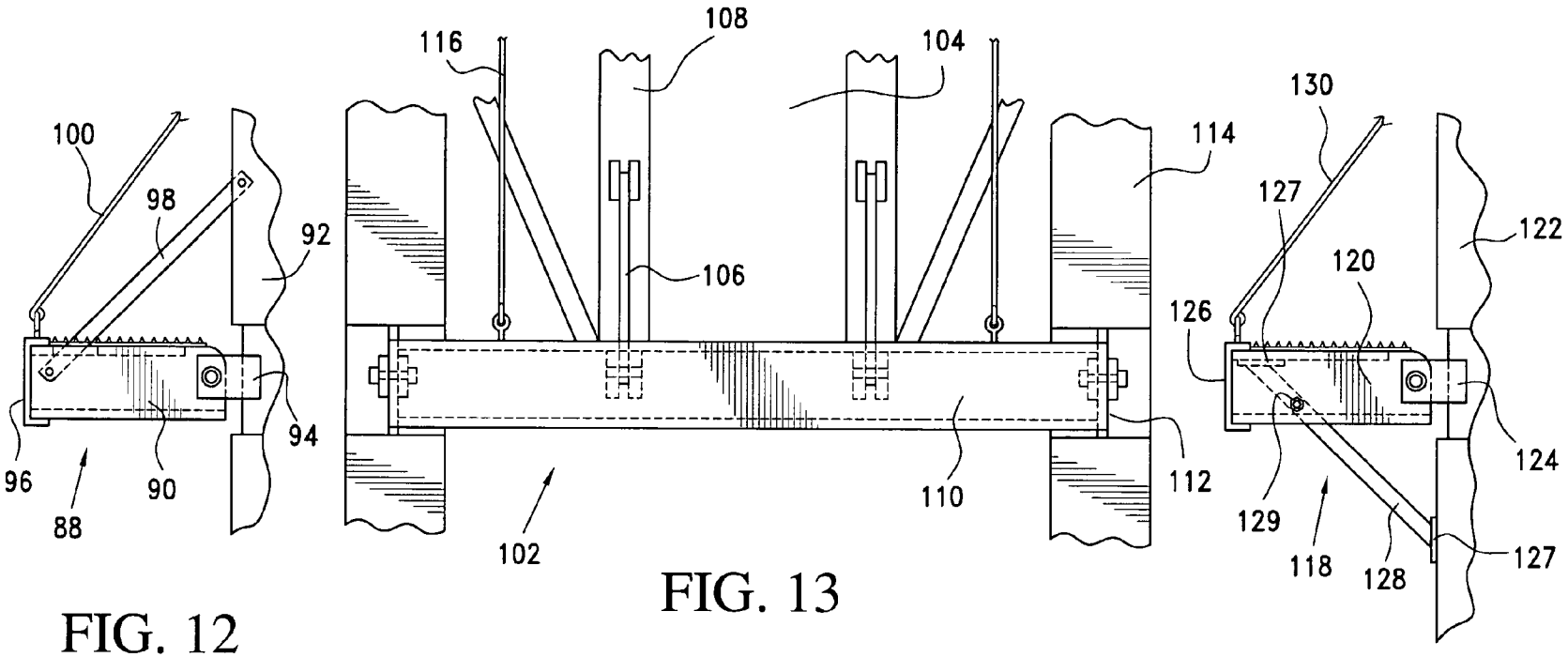
FIG. 12 is an side elevational view showing an embodiment of an outrigger assembly.
FIG. 13 is a frontal elevational view showing another embodiment of an outrigger assembly.
FIG. 14 is a side elevational view showing another embodiment of an outrigger assembly.

FIGS. 12-15 illustrate embodiments of foldable outriggers that may be installed on the stairtower. In FIG. 12, an embodiment of an outrigger 88 includes a center beam 90 pivotally connected to a column 92 of the stairtower by a pivot device or plate 94 located at a first end of the outrigger 88. A channel element 96 is positioned about a second end of the center beam 90 at a second end opposed from the first end of the outrigger 88. Struts 98 are pivotally connected to the second end of the outrigger 88 and the column 92, and are provided to retain and support the outrigger 88. In this embodiment, the struts 98 are positioned vertically above the center beam 90. Support cables 100 are joined to the second end of the outrigger 88 and connect to the column 92.

FIG. 13 shows an embodiment of an outrigger 102 adapted for use along a side of the stairtower having a portal 104. The outrigger 102 includes first struts 106 that are detachably mounted onto a web member 108 bordering the portal 104. The first struts 106 are pivotally connected to a channel element 110 of the outrigger 102 that in turn is pivotally connected to second struts 112 which are pivotally connected to column 114. The second struts 112 are detachably mounted to the column 114, and permit removal of the channel 110 from the inventive stairtower to accommodate a ramp. Support cables 116 are joined to the outrigger 102 and connect to the column 114. This particular outrigger embodiment may be configured to block access to the portal 104 by raising the outrigger towards the portal as shown in FIG. 13, or opened to permit free passage through the portal.

FIG. 14 exemplifies another embodiment of an outrigger that may be used in the inventive stairtower. More specifically, outrigger 118 includes a center beam 120 pivotally connected to a column 122 by a pivot device or plate 124 located at a first end of the outrigger 118. A channel element 126 is positioned about a second end of the center beam 120 at a second end opposed from the first end of the outrigger 120. Struts 128 are pivotally connected to the second end of the outrigger 120 and the column 122, and are provided to retain and support the outrigger 88. In this embodiment, the struts 128 are positioned vertically below the center beam 120. Support cables 130 are joined to the second end of the outrigger 120 and connect to the column 122. Appropriate plates or brackets 127 may be used to mount struts 128 to the column 122 and the channel element 126.

FIG. 15 shows an embodiment of an outrigger 132 extending along a side of the stairtower without a portal. In this embodiment, the outrigger 132 includes struts 138 pivotally connected to the column 140 and extending upwardly therefrom to secure onto a center beam 134. The outrigger 132 has a channel element 136 secured along a face of the center beam 134. A safety structure 142 is provided which couples to diagonal members 144 of the stairtower and thereby secures entry to and from the side of the stairtower having the outrigger 132. Cables or other appropriate elements 146 provide support to the outrigger 132, and are connected to the inventive stairtower and the outrigger 132.

In each of the embodiments discussed herein, a top surface of the outriggers may include or be constructed from expanded metal, perforated metal, bar grating, fiberglass grating, hex metal and other suitable decking materials. It is important that the outriggers prevent objects from falling beyond each respective level of the stairtower and it will be understood that the stairtower is not limited to the embodiments of the outriggers described herein. It is thus envisioned that the stairtower may comprise any outrigger safety device known to a skilled artisan for preventing falling objects from a level of the platform.

FIGS. 16 and 17 show an embodiment of a pivotable ramp 148 that may be provided along the sides of each level of the lateral members 14 of the inventive stairtower. As shown in FIG. 16, the ramp 148 blocks the portal 150 when the ramp is in a retracted or stowed position. The ramp 148 is pivotally connected to a lateral member 152 of a first level. A tow element 156, such as a rope or cord, extends around a pulley 158 connected to a lateral member 154 of a second level and connects to a hitch device 160 connected to the ramp 148. While the pivotable ramp of this embodiment is shown in cooperation with lateral members of a portal and thus a platform section, the ramp may also be pivotally mounted along the sides of the stairtower corresponding to the portals and leading to and from the intermediate landing.

FIG. 17 illustrates the ramp 148 in a deployed position. As shown, the ramp 148 extends from the lateral member 152 and pivots at hinge or points 162. The arrangement of the pivot points 162 permits storage of the ramp 148 within the platform level in which the lateral member 152 corresponds. The ramp 148 may include a guardrail system 164 provided to prevent workers and construction items such as tools from falling off the ramp to floor levels. The guardrail system may be comprised of midrails, mesh, intermediate vertical members, solid panels, and equivalent structural members. Similar to the outriggers, the ramp may be constructed from expanded metal, perforated metal, bar grating, fiberglass grating, hex metal, wood planks, and other suitable decking materials sufficient to withstand repeated loads.

Figure 18:
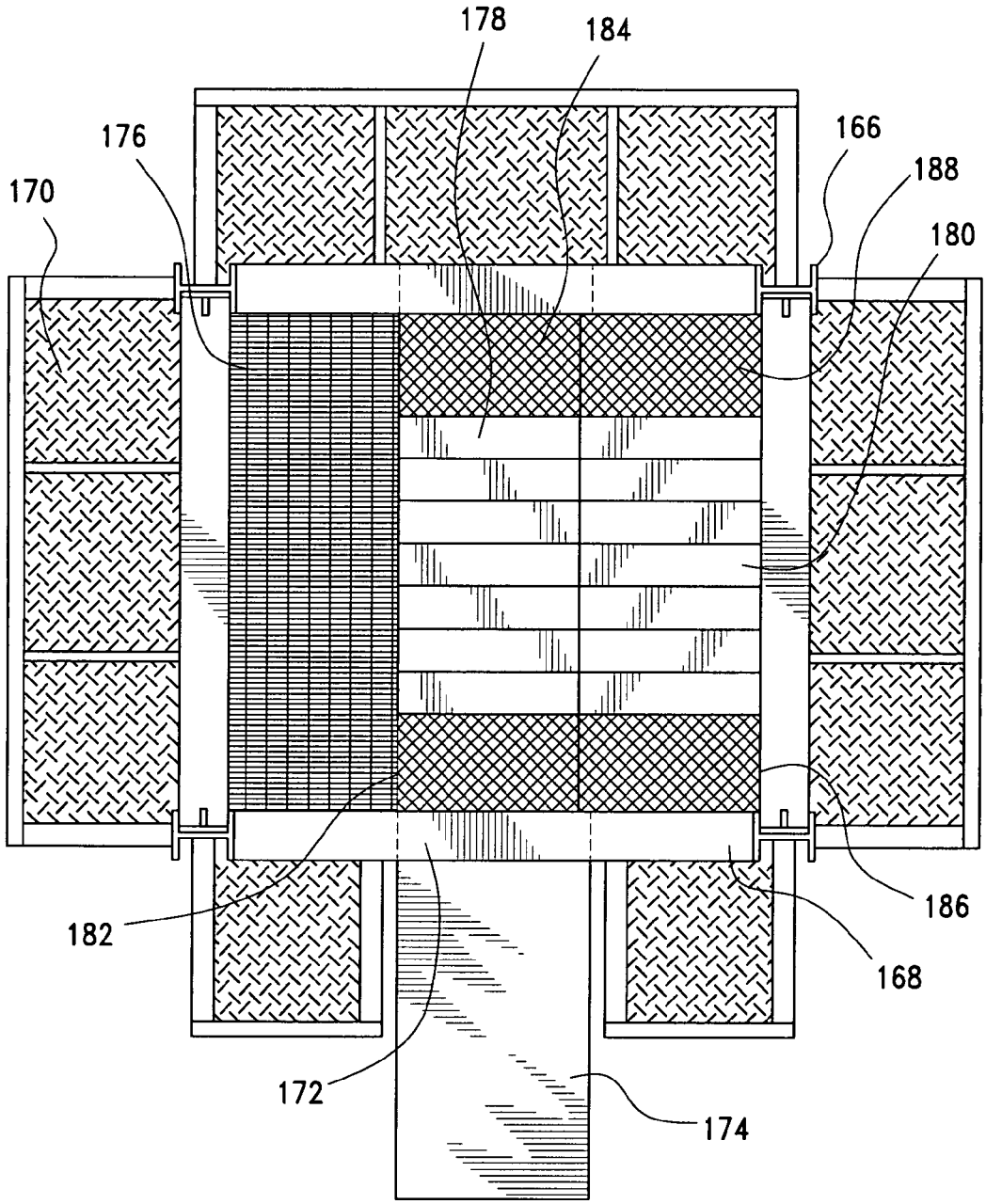
FIG. 18 is a schematic plan view showing an embodiment of a platform level of the stairtower of FIG. 1.

As exemplified in FIG. 18, an embodiment showing a level of the inventive stairtower is shown with embodiments and configurations of outriggers, a ramp, and a staircase. In this exemplary embodiment, column members 166 and lateral members 168 border the level and establish the periphery thereof. A plurality of outriggers 170 extend beyond the lateral members 168 with the exception of the region of the lateral members 168 defined by the portal 172. Extending from the portal 172 is a ramp 174 in a deployed position. The level includes a platform section 176 that is generally parallel to first and second stair segments 178, 180.

The first stair segment 178 includes first and second landing portions 182, 184. The first landing portion 182 of the first stair segment is shown as being generally parallel with the platform section 176 and contiguous therewith. The second landing portion 184 of the first stair segment 178 is juxtaposed to the second landing portion 188 of the second stair segment 180 to define a generally contiguous landing, as discussed more fully above. The first landing portion 186 extends to the next vertically succeeding level above the level shown in FIG. 18.

Figure 19:
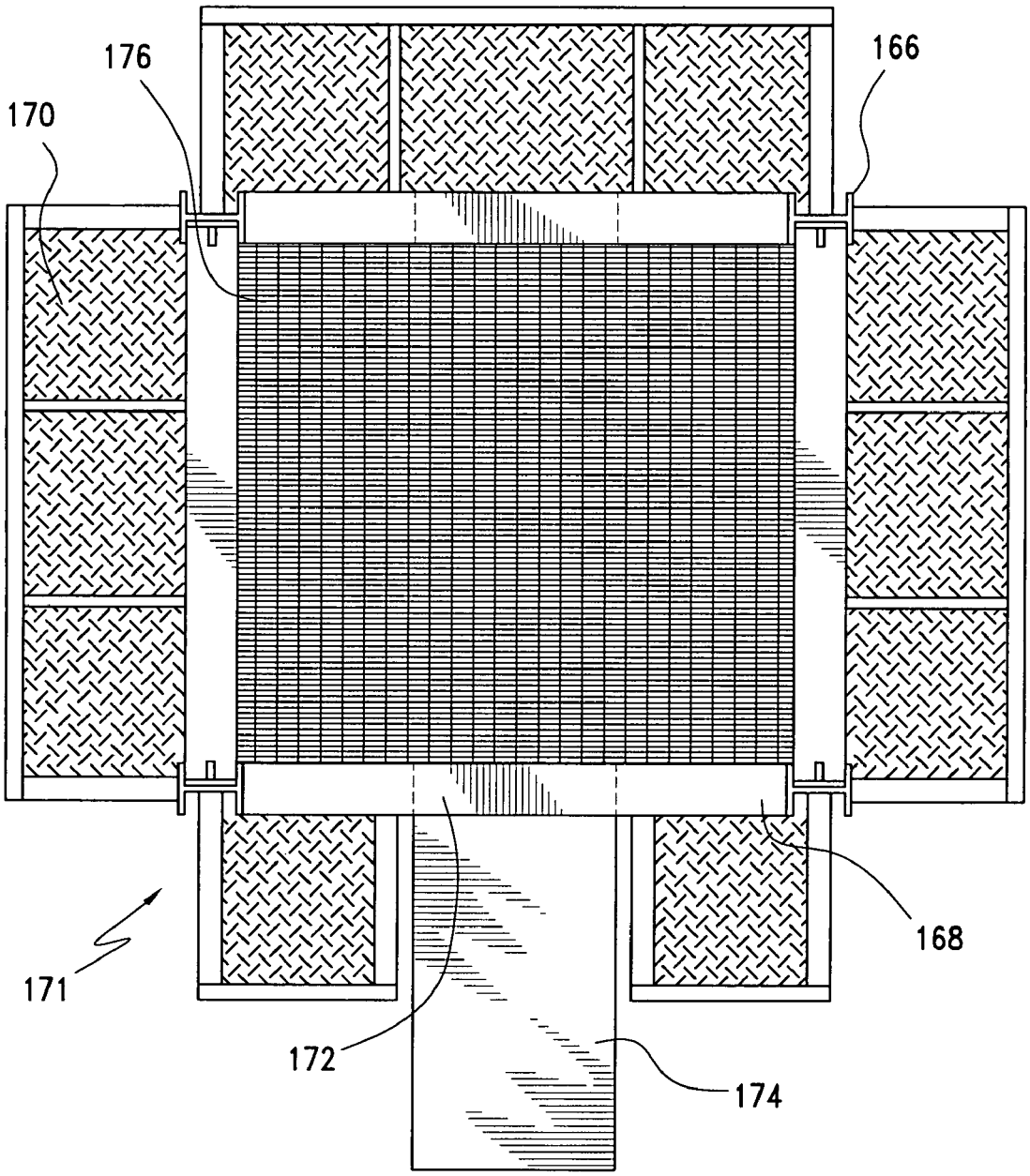
FIG. 19 is another schematic plan view showing an embodiment of a base platform level of the stairtower of FIG. 1.

FIG. 19 is similar to FIG. 18 except that platform level 171 lacks a staircase. This level 171 is preferably used as the base level of a stairtower according to the invention.

It will be understood that the outriggers are not limited to being installed on the stairtower so as to be substantially parallel with the platform or lateral members of each level. Alternatively, the outriggers may be positioned and vertically spaced along the column members at any location thereof.

As briefly discussed above, the inventive stairtower includes a base assembly for securing and supporting the inventive platform structural members. An embodiment of a base assembly 190 is shown in detail in FIG. 20. In this embodiment, the base assembly 190 is secured to a base portion of column members 192. The base assembly 190 includes a housing 194 that supports a plurality of support beams 196 that are extensible relative to the housing 194. The support beams 196 are slidably supported on track elements 222 disposed within the housing 194.

Each support beam 196 defines first and second ends 198, 200. The first end 198 of each support beam 196 connects to an anchor device 202 that generally extends perpendicularly from the support beam 196. The second end 200 of each support beam 196 connects to a first end 206 of a turnbuckle 204 or similar device. Each turnbuckle 204, in turn, has a second end 208 that is pivotally connected to a corner member 212 defined between lateral members 210 extending above the base assembly 190 and column members 192 bordering the base assembly 190. The base assembly 190 also includes a plurality of sliding support legs 214 that are each secured at a first end 216 thereof to the first end 198 of each support beam 196, and are slidably connected at a second end 218 thereof to one of the column members 192 by a slider device 220.

Figure 20:
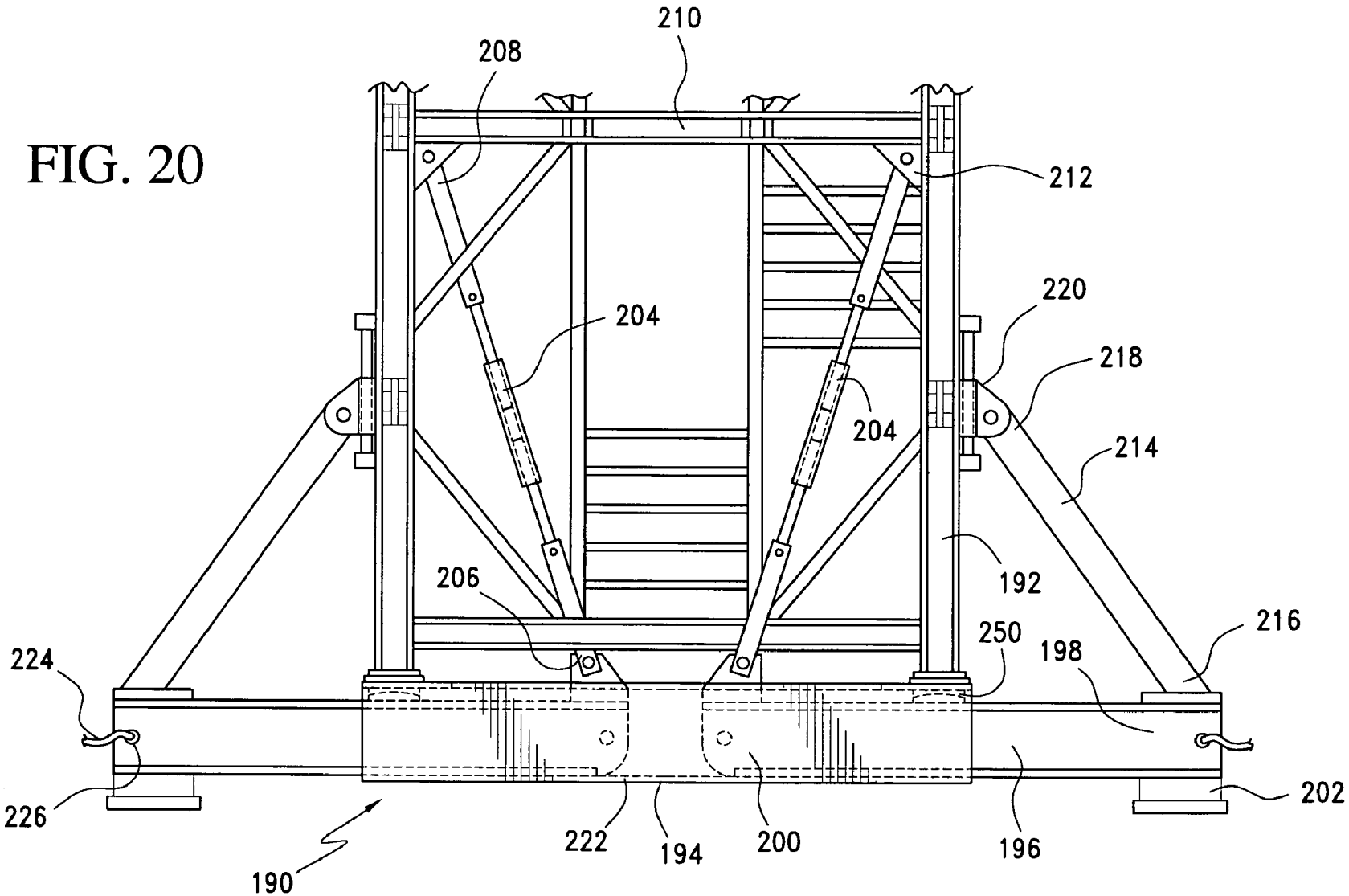
FIG. 20 is detailed frontal elevational view of a base assembly shown in FIG. 2.

A suitable tow element or elements 224 may be provided to assist in deployment of the support beams 196 outwardly from the housing 194 or to stow the support beam inwardly into the housing 194. In the embodiment shown in FIG. 20, the tow elements 224 comprises rope segments connected to eyelets 226 formed at the first end 198 of the support beams 196. It will be noted that the support beams 196 in FIG. 20 are shown in a deployed position defined by the outwardly extension of the support beams 196 relative to the housing 196. Eyelets 226 are also formed on the second end 200 of the support beams 196. It will be understood that tow elements can be secured to eyelets 226 for positioning the support beams 194 within the housing 194, as will be shown in FIG. 21. Of course, the tow elements and eyelets may be modified or replaced with alternative tow elements and connectors known to a skilled artisan.

Figure 21:
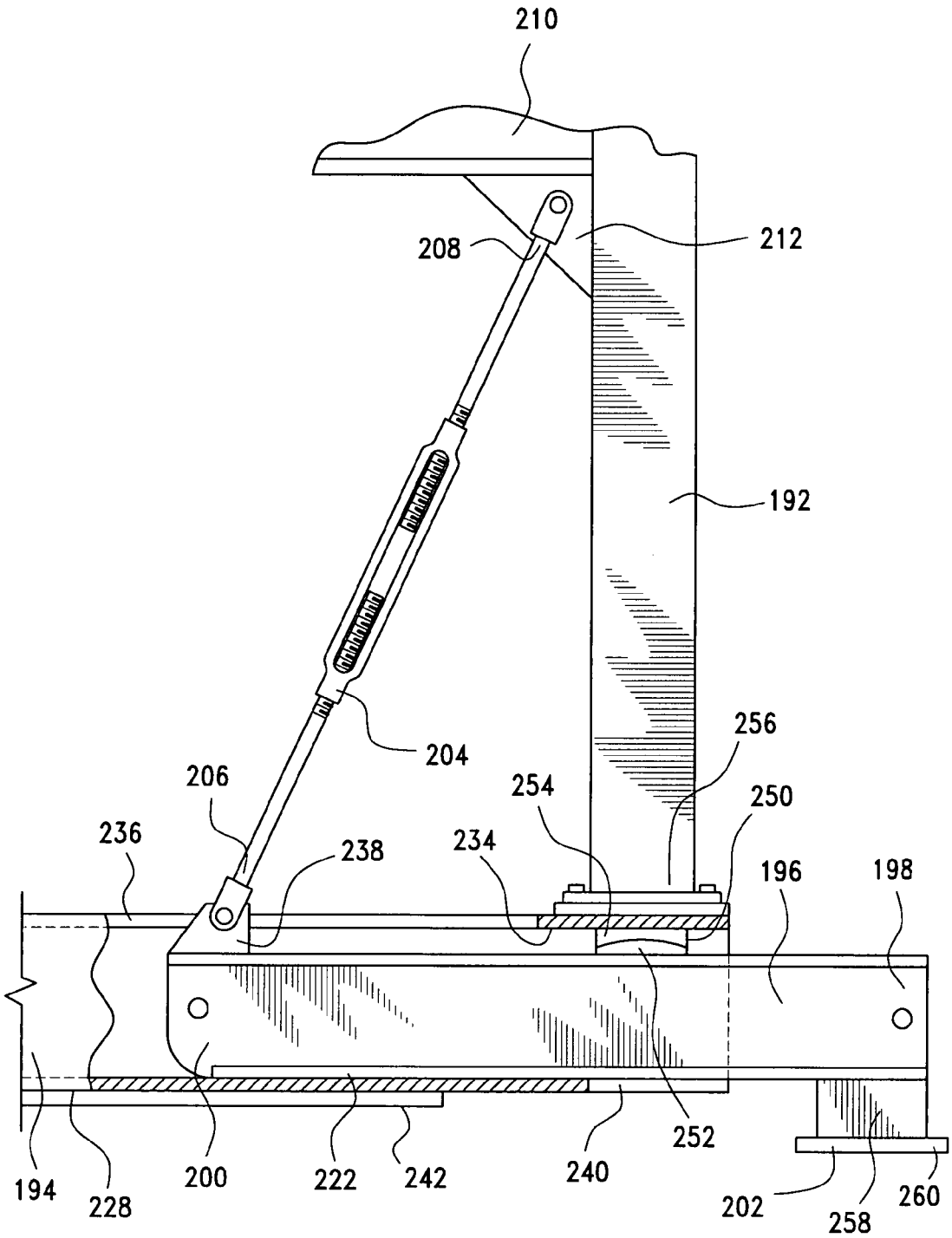
FIG. 21 is a sectional elevational view of an embodiment of a base assembly.
Figure 22:
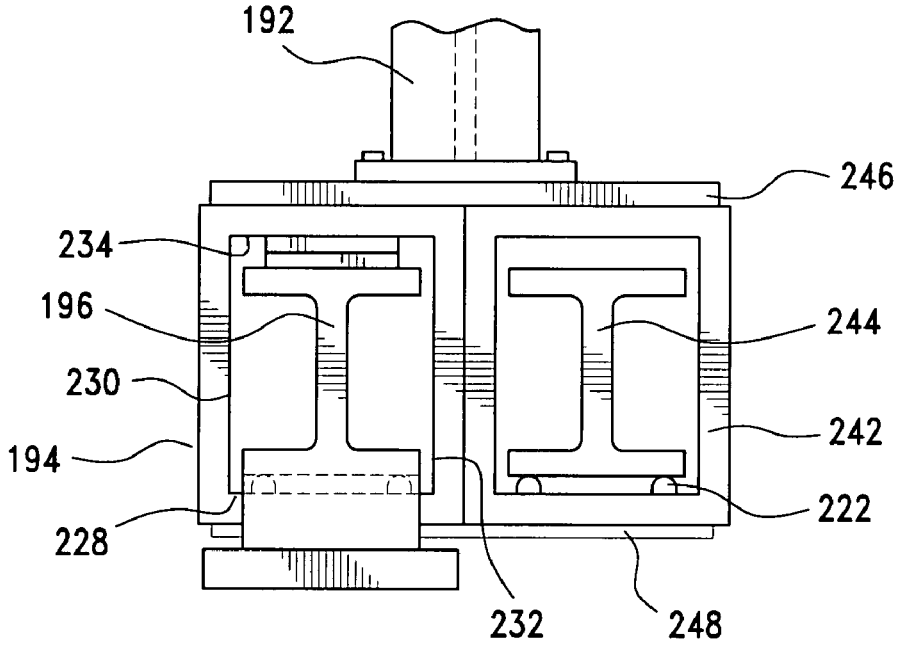
FIG. 22 is a sectional side elevational view of a portion of the base assembly shown in FIG. 20.

In reference to FIGS. 21 and 22, the housing 194 comprises a box beam-like structure having a bottom surface 228 upon which track elements 222 are supported, opposed side portions 230, 232, and a top surface 234 opposed to the bottom surface 228. According to this embodiment, the top surface 234 defines a longitudinally extending passageway 236. Mounted near or at the second end 200 of the support beam 196 is a mount 238 secured thereon. The first end 206 of the turnbuckle 204 is pivotally joined to the mount 238, thereby connecting the turnbuckle 204 between the support beam 196, and the column members 192 and the lateral members 210. The passageway 236 is configured to permit the mount 238 to extend at least partially therethrough as the support beam 196 slides within the housing 194.

While shown schematically in FIG. 20 as being connected to the support beams 196, the turnbuckles 204 are preferably only mounted to the support beams 196 when the support beams 196 are fully extended from the housing 194.

It will be noted that the bottom surface 228 of the housing 192 corresponding to the first end 198 of the support beam 196 may have a recessed portion 240 to accommodate the support beam 196 therewithin so as to permit the anchor device 202 to be stored within the confines of the housing 194.

FIGS. 21 and 22 both show an embodiment of the configuration of adjacent housings 194, 242. In this embodiment, the housings 194, 242 extend parallel and adjacent to one another under the column member 192. The support beams 196, 244 contained within the housings 194, 242 are arranged to extend in different directions, as exemplified by the anchor device 202 on support beam 196. The housings 194, 242 may be joined together by first and second reinforcing plates 246, 248.

As illustrated in FIG. 21, the base assembly 190 includes a pivot plate assembly 250 corresponding to each support beam 196, and comprises first and second plates 252, 254. The first plate 252 is mounted on the support beam 196 and has a convex profile, and the second plate 254 is mounted on base end 256 of the column members 254 and has a concave profile complementary to the convex profile of the first plate 252. The first and second plates 252, 254 are positioned and configured so that upon outwardly extension of the support beam 196 from the housing 194, the first and second plates 252, 254 mate and thereby assist to prevent movement of the support beam 196. Moreover, due to their profiles, the first and second plates 252, 254 wedge against each other under the weight of the stairtower structural members thereabove.

When installing or removing the stairtower from a work site, it is intended that the support members 196 may be lifted from the track elements or lowered so that the first and second plates 252, 254 may be dislodged from one another.

It will be noted that the invention is not limited to the pivot plate assembly 250 shown above, and the scope of the invention is envisioned to cover all similar devices or assemblies that impart the benefits and advantages of the pivot plate assembly herein described.

In FIG. 21, the support beams 196 are shown in a stowed position within the housing 194 resting upon the track elements 222 mounted on the bottom 228 of the housing 194. The track elements 222 may be a pair of parallel and longitudinal beams substantially narrower in cross-section than the support beam 196 and projecting from the bottom 228 of the housing 194. It will be understood, however, that the track elements 222 may be modified such that in alternative embodiments the track elements and support beams comprise a plurality of track-like elements in combination with rollers or any other devices or structures that improve the sliding of the support beams 194 relative to the housing.

As briefly described above, the support beams 196 each include the anchor device 202 connected to the first end 198 thereof. In the embodiment shown herein, each anchor device 202 includes a vertical extension 258 mounted at the first end 198 of the support beam 202, and an anchor pad 260 mounted on the vertical extension 258 opposite the support beam 196. The vertical extension 258 may comprise any suitable structural configuration sufficient to extend and support the anchor pad 260, while withstanding the weight of the stairtower. The illustrated anchor pad 260 comprises a plate joined to the vertical extension 258. It will be noted that the anchor pad may comprise any suitable configuration or material that can sufficiently hold or support the stairtower in place. The vertical extension and the anchor pad may be detachably mounted to and from one another, and the vertical extension may be detachably mounted to the support beam.

Figure 23:
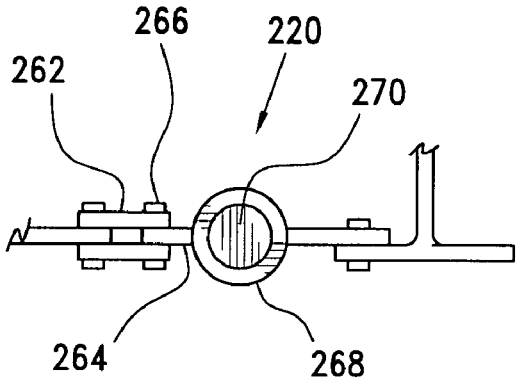
FIG. 23 is a top plan view of an embodiment of a slider device shown in FIG. 20.

FIGS. 20 and 23 illustrate an embodiment of the slider device 220. The slider device 220 includes a bridging element 262 connected to the second end 218 of the sliding leg 214. The bridging element 262 is pivotally connected to a spacer 264 and secured therewith pins 266. The spacer 264, in turn, is connected to a slider sleeve 268 which encircles a slide pin or shaft 270 that extends from and is parallel with the column member 192. The slide pin 270 is secured to the column 192. In operation, the slider device 220 is coupled to the sliding leg 214 to permit the sliding leg 214 to adjust in movement according to the extension of the support beam 196, and moreover provides additional support to the extended support beams 196.

Figure 24:
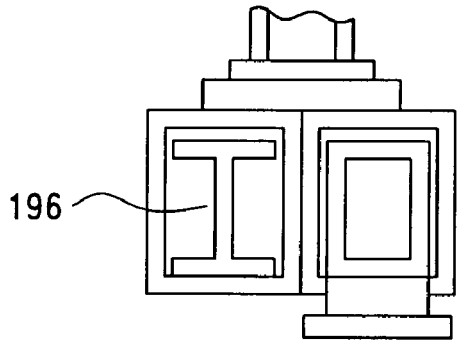
FIG. 24 is a side elevational view showing embodiments of support beams in an embodiment of a base assembly.

As shown in FIG. 24, the support beams may take the form of a variety of beams having a plurality of different cross-sectional shapes. For example, the support beams 196 may be a box beam or an I-beam. It will be understood, however, that the cross-sectional shape of the support beams 196 should be sufficiently configured so as to accommodate the aforementioned devices, assemblies, and mounts described herein and appropriate equivalents considered by a skilled artisan.

Figure 25:
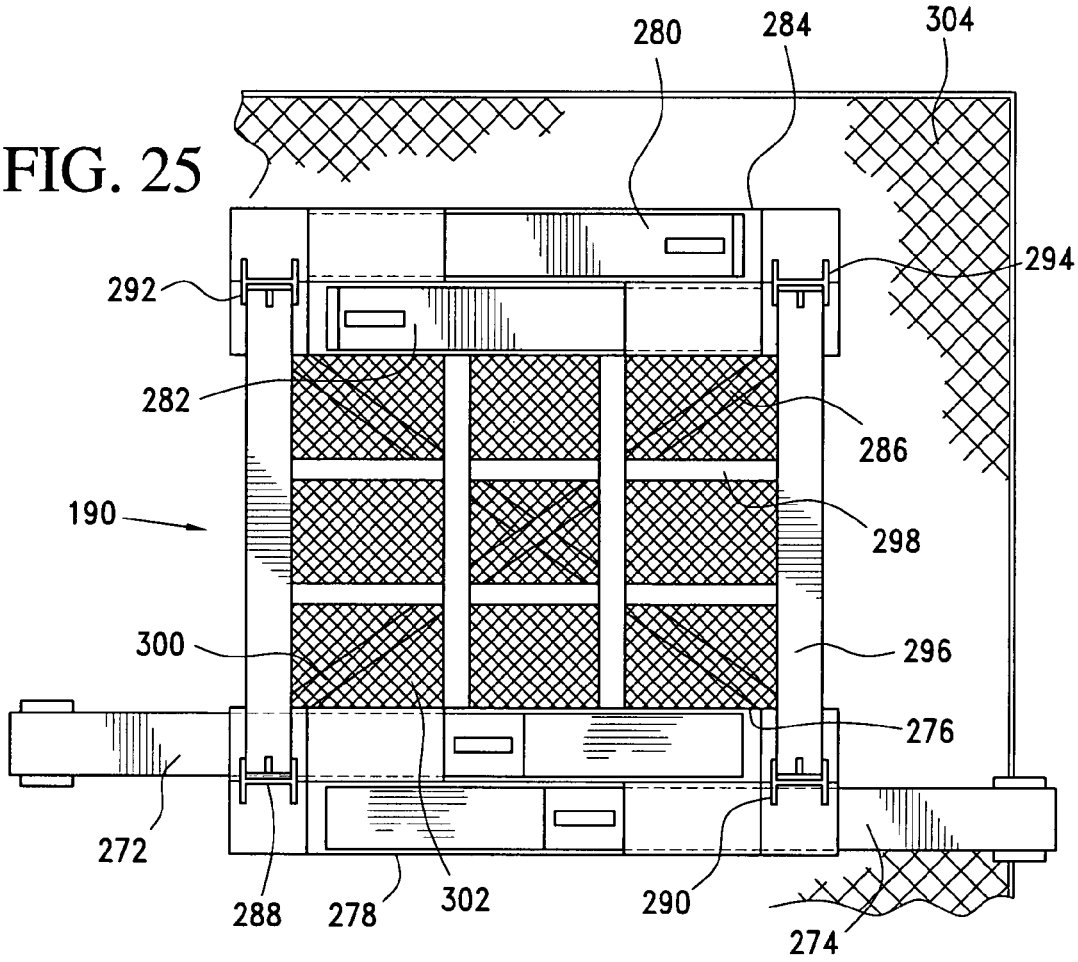
FIG. 25 is a schematic top plan view showing an embodiment of a base assembly.

FIG. 25 exemplifies an embodiment of a base assembly 190 of the inventive stairtower wherein support beams 272, 274 are deployed by extending from their respective housings 276, 278 along a first side of the stairtower, and support beams 280, 282 are retracted within their respective housings 284, 286 along a second side of the stairtower. As shown, the housings 272, 274, 284, 286 are mounted underneath respective column members 288, 290, 292, 294 such that the cross-section of the column members 288, 290, 292, 294 extends at least a portion over the width of the respective housings 272, 274, 284, 286.

A plurality of transverse members 298 are provided which reinforce the base assembly 190 and span the lateral members 296. Moreover, diagonal members 300 extend between diagonally opposed column members 288, 290, 292, 294, and may be provided to add support to the base assembly 190. The base assembly also includes a deck 302 bordered by the lateral members 296 and is supported by the transverse and diagonal members 298, 300. The deck 302 may be constructed from expanded metal, perforated metal, bar grating, fiberglass grating, hex metal and other suitable conventional decking materials and configurations known to one skilled in the art.

It will be understood that the inventive stairtower is not limited to having reinforcing transverse members and the diagonal members to merely reinforce the base assembly, but any of the levels of the inventive stairtower may be provided with such transverse and diagonal members to structurally reinforce the platform sections and staircases.

Safety nets 304 or other appropriate safety devices such as screens, mesh, solid panels and equivalent devices may be provided about the periphery of the base assembly 190. Moreover, it will be understood that any other level of the inventive stairtower may include appropriate safety nets or devices whereat such safety nets or other safety devices are desirable or necessary.

It will be noted that the base assembly may be provided with a passageway extending therethrough that provides access from below the base assembly. In particular, this particular feature is envisioned to provide access to the inventive stairtower for workers from manholes below the base assembly.

Figure 26:
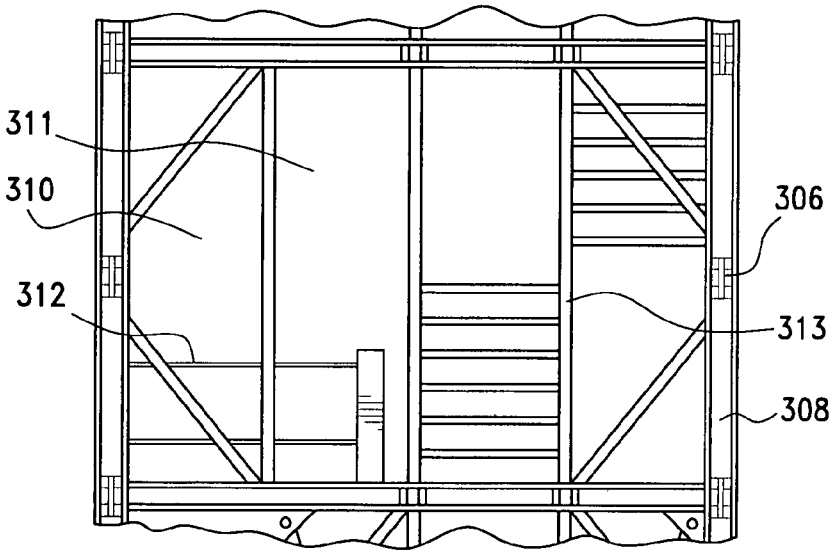
FIG. 26 is a front elevational view showing an embodiment of a level of the inventive stairtower.

FIG. 26 shows an embodiment of a stairtower including slots 306 that are vertically spaced along column members 308. The slots 306 are configured for attachment of the outriggers, such as with the aforementioned struts, in a fashion similar to those shown in FIGS. 12-14 and described above. Moreover, each level 310 of the inventive stairtower may include a guardrail system 312. The guardrail system 312 may include midrails, screens, mesh, intermediate vertical members, solid panels, and equivalent structural members capable of withstanding, without failure, a force applied in any downward or horizontal direction.

In the embodiment shown in FIG. 26, this level 310 is exemplary of a "double" wide portal 311. This portal 311 is defined by diagonal members 313, which when combined, form a portal having a width less than a width of diagonal members of a "single" width portal described more fully above in view of other embodiments.

FIG. 27 illustrates another embodiment of a feature of the stairtower of the invention. More particular, a ladder 314 may be connected to a level 316 of the stairtower to provide temporary entry to the level. The ladder 314 may be connected to the stairtower so that it either ascends to a level 316 or, in the alternative, so that it descends onto the level 316. The ladder 314 may be any type of ladder known to a skilled artisan and may be coupled or connected to the stairtower any known fashion. It will be noted that the ladder may be connected to any level of the stairtower.

FIG. 28 shows another embodiment of a feature of the inventive stairtower. Specifically, a trolley 318 is provided which is mountable and transportable along a trolley beam 320 connected to column members 321. The trolley 318 includes a handle 322 extending outwardly from a first roller assembly 324. The handle 322 is intended to be accessed from an upper level 326 directly above the first roller assembly 324 so as to be positioned to overhang a lower level 328 directly below. A locking pin 330 is provided which is configured to extend through a handle stem 332 of the handle 322 and into one of a plurality of bores 334 formed along the longitudinal length of the trolley beam 320 to secure the trolley 318 therewith.

The first roller assembly 324 is principally provided for transport of the trolley 318 along the trolley beam 320 and a lateral member 336 upon which the roller assembly 324 may be installed. A second roller assembly 339 may be provided which may be arranged to roll along a beam member 337 which runs transversely to lateral member 336. The trolley 318 may include a pulley 338 that extends into the lower level 328 and a tow element 340 extensible therefrom. It will be understood that the various components of the trolley 318 may be modified or replaced with components having similar functions as those described herein. Moreover, the mounting of the trolley onto the trolley beam is not limited to the method and manner described herein but may be modified as considered expedient by a skilled artisan.

As illustrated in FIG. 29, an embodiment of the inventive stairtower includes a top level 342. In the embodiment shown herein, the top level 342 includes an exit structure 344 leading from a staircase 346. The exit structure 344 is formed of structural members and has a roof 348 with a protective covering formed of a material such as corrugated sheet metal. Leading from the exit structure 344 is a platform section 350 which borders the exit structure 344, and may be formed of the aforementioned conventional decking materials and configurations herein described.

A safety cable 352 or guardrail system of the type herein described may be provided which surrounds the periphery of the top level 342 bounded by column members 354. The top portions 356 of the column members 354 include suitable hitch devices 358 secured thereon. The hitch devices 358 may be used to connect to a tow element 264, such as rope, chains or cables that in turn connect to a crane (not shown) for transport and placement of the platform. Other devices and methods may be used for transport and placement of the stairtower as would be deemed effective by a skilled artisan and which are conventionally known.

Figure 30:
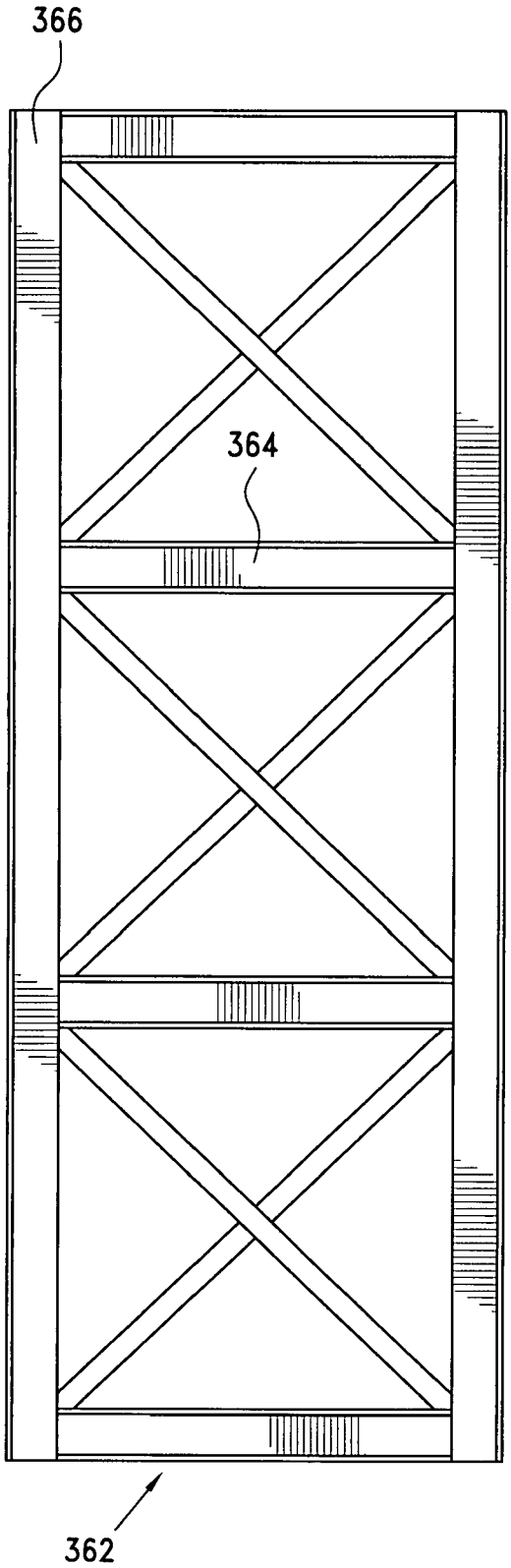
FIGS. 30 and 31 show embodiments of truss sections for use in the inventive stairtower.
Figure 31:
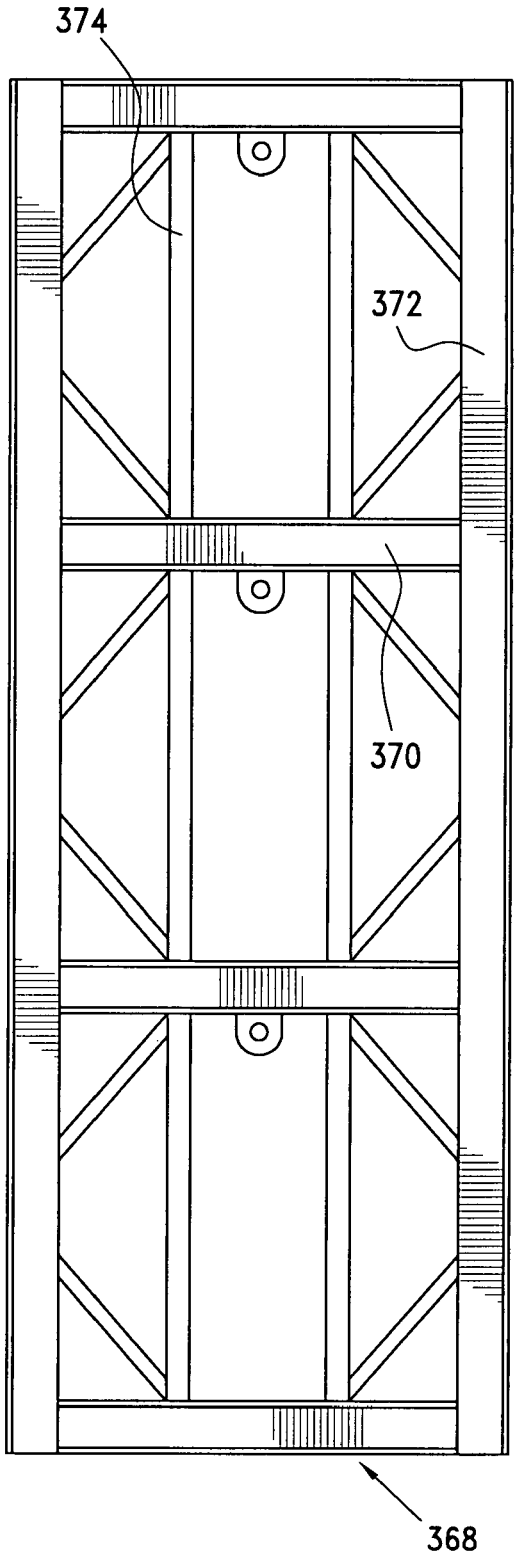

FIGS. 30 and 31 illustrate truss and structure embodiments that may be employed in the stairtower of the invention, and thus provided as modular components. Since the inventive stairtower may be offered in modular forms, different side panels may be fabricated and assembled corresponding to portions of the stairtower. Turning to FIG. 30, a three tier side panel truss 362 is illustrated. Truss 362 may be constructed from a variety of different structural members, including I-beams, box beams and T-irons. For example, truss 362 includes lateral members 364 defined as I-beams, and column members 366 defined as T-irons.

FIG. 31 shows a three tier side panel truss 368 having a plurality of portals 370. Similar to the truss 362 shown in FIG. 30, the lateral members 370 in the truss 368 are constructed from I-beams and the column members 372 are constructed from T-ions. Moreover, in this particular embodiment, T-irons are used to form web members 374. The selection of the support members may vary depending on the desired strength characteristics of the stairtower and size constraints.

As noted above, inventive stairtower may comprise a plurality of modular components. The components may be assembled as platform level lengths, as shown in FIGS. 3-5, or may be provided as side trusses as shown in FIGS. 30 and 31. Multiple other embodiments are envisioned and may summarily be used in erecting the inventive platform.

According to one method for erecting the inventive stairtower, the inventive stairtower is erected in a building construction. The building construction has a plurality of superimposed floor levels and a plurality of vertically extending column members located at horizontally spaced locations. The method first involves the step of placing a first modular component having a base assembly into a cavity of building construction and securing the base platform unit against the ground. Preferably, the first modular component has at least two platform levels that correspond to floor heights of the building construction, and a staircase extending between each platform level and providing access to the stairtower from a ground level. Next, the method includes extending the height of the stairtower by installing a sequential modular platform assembly on the first platform assembly to increase the height of the stairtower. The method of adding the sequential modular platform assembly may be subsequently repeated to move the stairtower upwardly as the height of the building construction increases during construction.

D. Alternate Embodiments of a Stairtower

Figure 32:
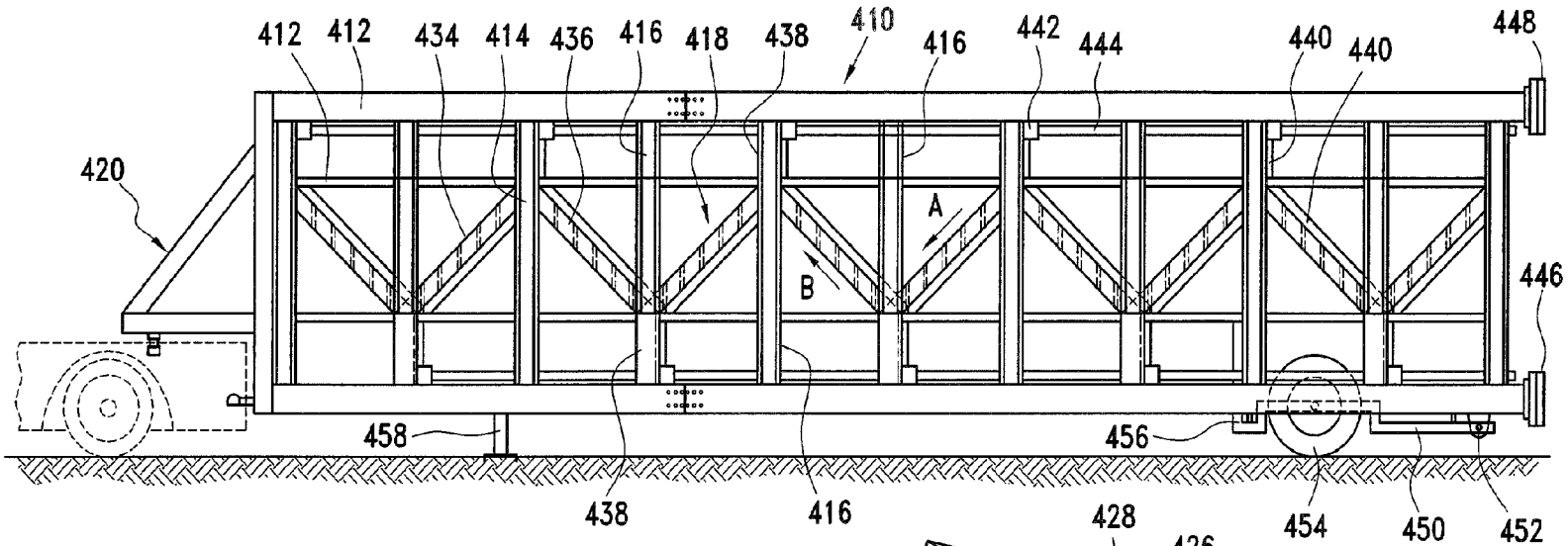
FIG. 32 is an elevational view of one side of another embodiment of a multilevel access stairtower embodying features of the inventive stairtower.

An alternate embodiment of a stairtower 410 is shown in FIG. 32. The stairtower 410 has a generally similar construction to those discussed above, may utilize any of the above mentioned safety features, such as toe kicks and safety rails, or any other safety feature necessary for Occupational Safety and Health Administration (OSHA) compliance, and may be formed from any of the materials and connection methods previously mentioned. Specifically, the stairtower 410 has vertical column members 412 and lateral members 414. The vertical column members 412 are arranged to form a tower having four corners. Additional vertical members 412 are also spaced between the column members 412 at the corners to provide structural support and attachment points for interior structures of the stairtower 410.

The lateral members 414 are spaced vertically along the column members 412 and each position of the lateral members 412 defines a level of lateral members 412. The lateral members 412 also provide structural support and attachment points for interior structures of the stairtower 410. Of course, other suitable structural elements may also be provided to provide structural support to the stairtower 410, as discussed above in detail.

Staircases 418, of a type similarly described above, are provided in the interior of the stairtower 410. As previously discussed, the staircases may be defined by a first stair segment 434 and a second stair segment 436. The first stair segment 434 may be oriented at an angle to the vertical column members 412 such that they lead in first inclined direction A. Similarly, the second stair segment 436 may be oriented at a different angle to the vertical column members 412 such that they lead in second inclined direction B.

As shown in FIG. 41, each of the first and second stair segments include first and second landing portions 438 in addition to the stair portions extending between the first and second landing portions 438. The first and second stair segments 434, 436 are each independently removably connected to the interior of the stairtower.

The connection may be as described above with reference to FIGS. 7-8. Of course any suitable connection may be utilized to removable connect the stair segments to the stairtower. Exemplary connections include threaded bolts and nuts, removable pins and pin receiving holes, extending pins on the column members and receiving hooks on the stair segments, or any other suitable connection system.

When the stair segments are positioned in the stairtower 410, they form staircases 418 that extend between alternating levels of lateral members 414. At the levels of the lateral members 414 between the alternating levels of lateral members 414, platform landings are formed by the juxtaposed first and second landing portions 438 of the first and second stair segments 434, 436, respectively.

In reference to FIG. 43, first and second stair segments are shown adjacent to each other such that the juxtaposed first and second landing portions 438 form the platform landing section. While the stairtower 410 is shown with a width defined by the two adjacent stair segments, alternative configurations, as discussed above, may also be provided.

Figure 38:
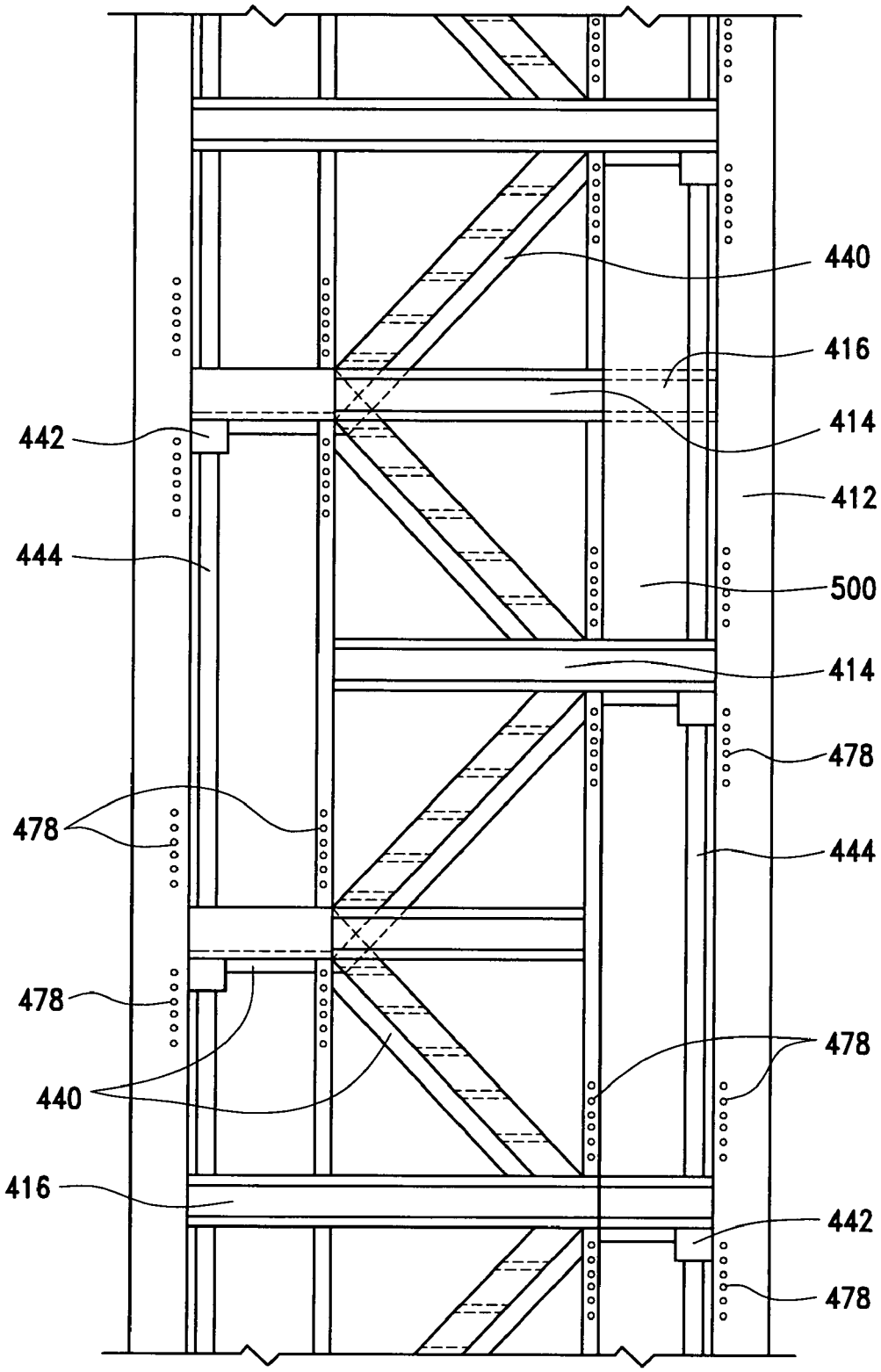
FIG. 38 is a partial side elevational view of multilevel access stairtower of FIG. 32 providing a more detailed view of the structure of the stairtower.

As shown in FIG. 38, the lateral members 414 each have a removable portion 416 at an end opposed to the end of the lateral member 414 where the platform landing is located. The removable portions 416 may be ⅓ or ¼ of the total length of the lateral members 414. Alternatively, the removable portions 416 may have any suitable length. These removable portions 416 may be removably connected to the vertical column members 412 via any suitable connection method as discussed above in relation to the stair segments. Of course, as discussed above, any suitable additional cross bracing or structural members may be provided in areas where the removable portions 416 have been removed.

Since the lateral members 414 have the removable portions 416 spaced at the intermediate levels of the lateral members 414, a portal 500 may be formed between alternating levels of lateral members 414. These portals 500 allow egress and ingress from the interior of the stairtower 410 such that workers may access a worksite through the portals 500.

As exemplified with reference to FIGS. 2 and 26, portals may also be formed in the opposed sides of the stairtower. Outriggers and ramps of a type previously described may be utilized with any of the portals disclosed herein.

Figure 39:
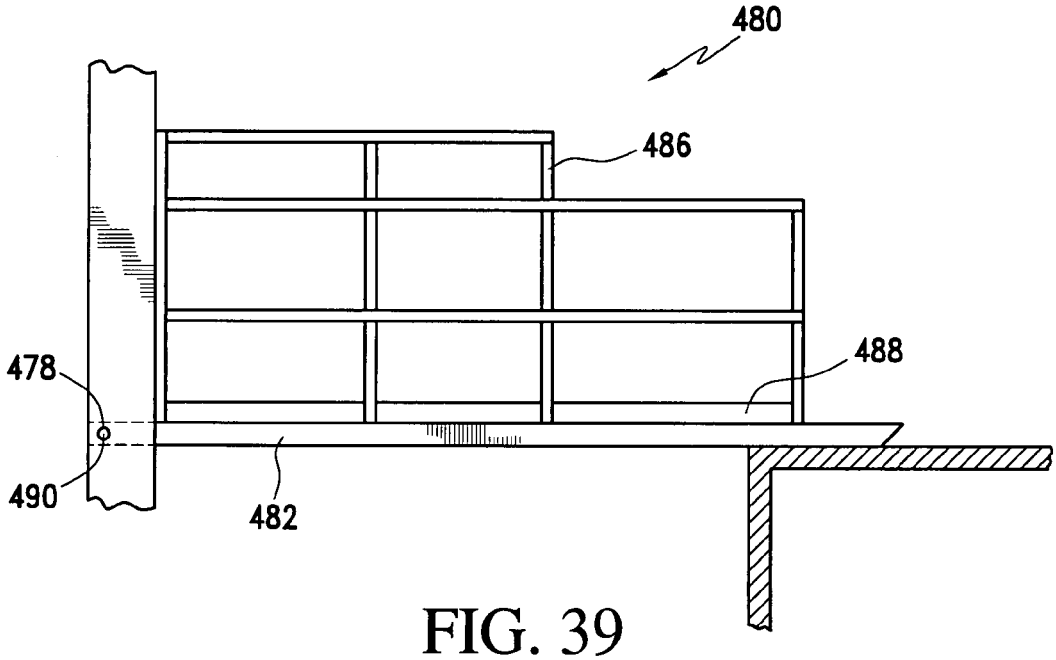
FIGS. 39 and 40 show an exemplary ramp and stairway for use with the inventive stairtower.
Figure 40:
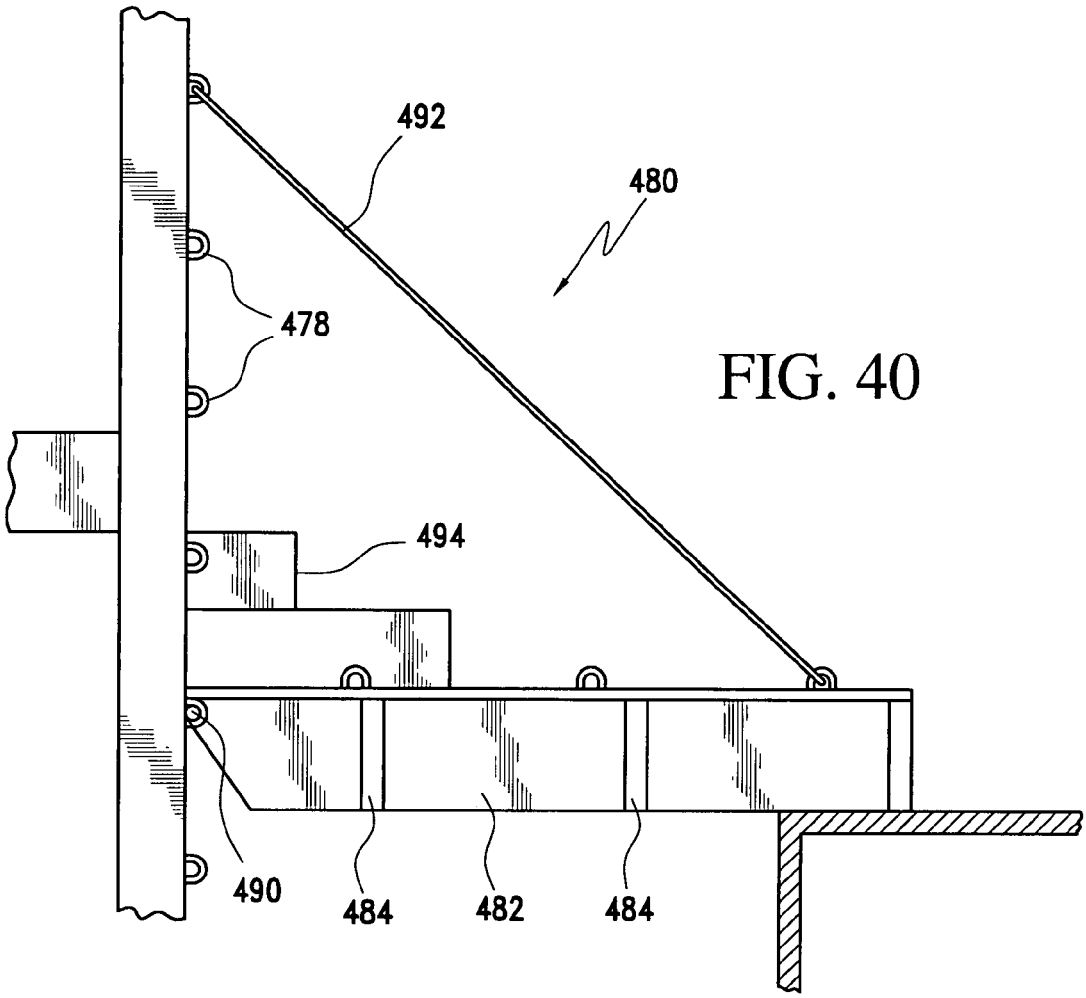

Further, as shown in FIGS. 39 and 40, an alternate configuration of a ramp 480 may be utilized with the portals. The ramp 480 includes a ramp platform 482. The ramp platform 482 may be mounted at any desired location on the column members 412 above, below, or corresponding with the level of the platform landing utilizing the various attachment points 478 located along the column members 412.

As described above, the ramps 480 may be removably and/or pivotally attached to the attachment points 478, for example by attachment pins 490 received within holes defining the attachment points 478. Of course suitable bearings may be provided to aid with raising and lowering the ramps 480 into place.

To aid with raising and lowering the ramps 480, and to provide a safety mechanism, cables 492 may be attached to the column members 412 and the ramp platform 482. The cables 492 may be connected in any suitable fixed or removable manner using clamps or eyelets of any suitable configuration.

As also shown in FIGS. 39 and 40, hand rails or safety fences 486 having a toekick 488 are also optionally provided. Post holes 484 may be provided along the edges of the ramp platform 482 to receive the ends of the posts that form the hand rails or safety fences 486. Thus, the hand rails or safety fences 486 may easily be removed so that the ramps 480 can be rotated to a stored position or more easily removed from the stairtower 410.

To further aid workers with accessing levels of a construction site that do not necessarily align with the platform landings, as discussed above, the ramp platforms 482 may be mounted above or below the platform landings. In order to provide a safer environment, removable steps 494 are optionally provided to ease the transition from the platform landing to the ramp platform, 482.

An exemplary configuration of this is shown in FIG. 40. The ramp platform 482 is positioned below the level of the platform landing. Steps 494 are provided to ease the transition down from the platform landing to the ramp platform 482. The steps 494 may be removably connected to the ramp platform 482 in any suitable fashion, for example with threaded bolts and nuts, flanges and clamps, or any equivalent structures.

To further aid with providing a safe working environment, the stairtower is provided with a system for removing debris or rainwater from the stairtower 410 without injuring workers. The system functions as follows. All of the landings 438, stair portions, and ramp platforms 482 may be substantially planar surfaces formed with perforations or holes therein. Suitable materials are grates or perforated planking, as discussed in detail above. To prevent debris and rainwater from falling through the perforations onto the heads or bodies of workers, catch pans 440, 496 are provided beneath each of the landings 438, stair portions, and ramp platforms 482.

With reference to FIGS. 41 and 42, the catch pans 440, 496 extend along and correspond to the landings 438, stair portions, and ramp platforms 482. The catch pans 440, 496 catch any debris or rainfall that may enter the stairtower in order to protect the workers therein. The catch pans 440, 496 may be permanently fixed to the structures, via welding, bonding, or other known techniques. Alternatively, the catch pans 440, 496 may be removably connected to the structures, in any manner previously discussed.

Figure 33:
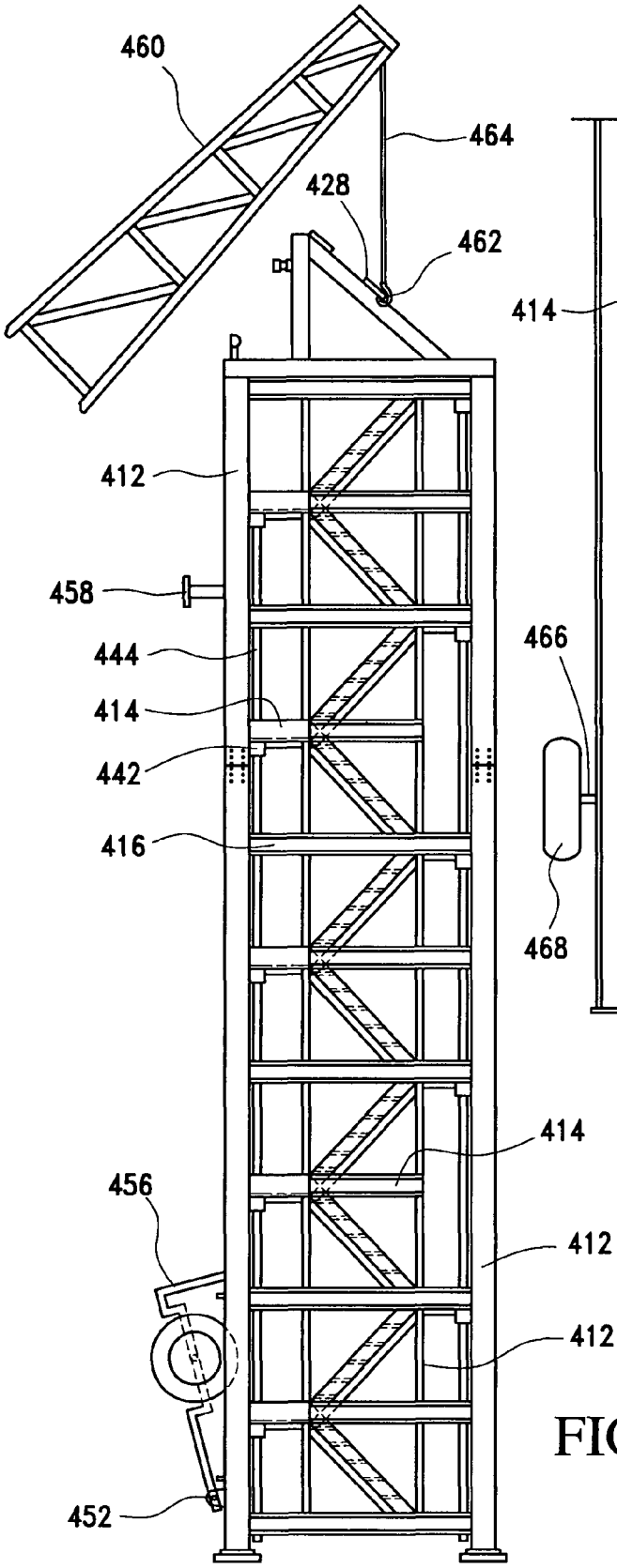
FIG. 33 is an elevational view of the multilevel access stairtower of FIG. 32 shown lifted to a vertical orientation.

As shown in FIGS. 32, 33, and 38, catch pans 440 lead to gutters 442 which collect the debris and rainwater. The catch pans 440 may be appropriately sloped such that the debris and rainwater are drawn to the gutters 442 under the force of gravity. The gutters 442 are in turn connected or integrated with leaders or downspouts 444 which allow passage of at least the rainwater therethrough. The leaders 444 may be hollow pipes or tubes formed in any suitable manner. The leaders 444 may be removably or fixedly connected to the structure of the stairtower 410 in any suitable manner using any method discussed herein. The leaders 444 may be connected internally or externally to either or both of the column members 412 and lateral members 414.

Collection screens may be inserted at the intersection of the gutters 442 and the leaders 444 such that debris larger than a predefined size does not travel into the leaders 444. Alternatively, since the grating or perforations of the landings and stairs act as a screen for debris of a size larger than the gratings or perforations, the gutters 442 and leaders 444 may not include a screen. Thus, debris that is received in the catch pans 440 may pass through the gutters 442 and into the leaders 444.

The leaders 444 may act as downspouts to take the rainwater and debris from the levels of the stairtower 410 down to the proximal end of the stairtower 410. The leaders 444 may be open ended at the proximal end of the stairtower 410 to allow the rainwater and debris to exit therefrom at the base of the stairtower 410. Alternatively, any suitable system, such as additional piping, may be utilized to transfer the debris and rainwater to a collection bin or system, or to otherwise draw the debris and rainwater away from the stairtower 410.

Additionally, the ramp platform 482 may also have gratings or perforations to provide a lighter structure. Thus, a catch pan 496 may be provided beneath the ramp platform 482 as an additional safety precaution. The catch pan 496 may perform in the same manner as the catch pans 440 to collect fallen debris and rainwater.

The catch pan 496 may be sloped downwards towards the stairtower 410. Thus, the catch pan 496 may also lead into the gutter 442 to allow debris and rainwater to be drawn away from the ramp platform 482 in a manner as discussed above.

Of course, the landings 438, stair segments 434, 436, and ramp platform 482 may all include planking or decking that has no perforations. As such, no catch pans, gutters, or leaders would be necessary to protect workers from falling debris. Further, since the stairtower 410 is not a hermetically sealed structure, rainfall may exit from the stairtower at each level of platform landings.

Having described the internal structures and safety features of the stairtower 410, reference is made again to FIG. 32. As shown in FIG. 32, the stairtower 410 may be transported at least partially assembled and in a horizontal orientation. To effectuate the transportation of the stairtower 410, a number of additional structures may be provided.

In particular, in order to allow the stairtower 410 to be positioned in a horizontal orientation without risking damage to the supporting structures of the stairtower 410, landing gear 458 and a wheel carriage 450 are provided along one side of the stairtower 410. The landing gear may be any standard landing gear and may include suitable hydraulic or mechanical lifting capabilities. Alternatively, the landing gear may be simply a support post with a support platform. The landing gear 458 may be removably attached to the structure of the stairtower 410, so as to be removed from the stairtower 410 once the stairtower 410 is positioned for use, as will be discussed below.

In a further alternative, the landing gear may be pivotally attached to the stairtower 410 such that once the stairtower 410 is erected, the landing gear will collapse and lie flat against the side of the stairtower 410.

Figure 36:
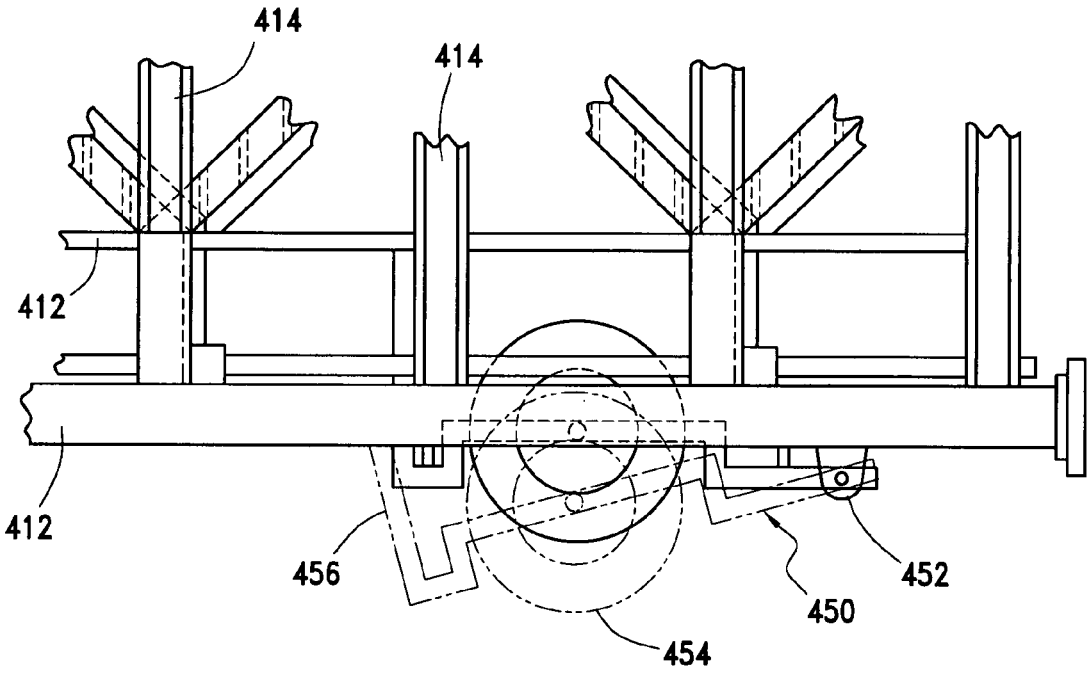
FIG. 36 is a partial view of the multilevel access stairtower of FIG. 32 showing two positions of the slidable and removable wheel carriage.

A first exemplary embodiment of a wheel carriage 450 is shown in FIGS. 32, 33, and 36. In this embodiment, the wheel carriage 450 is removably attached to the stairtower 410. Thus, similarly to the landing gear as discussed above, the wheel carriage 450 may be removed once the stairtower 410 has been erected on site. However, due to the additional features to be discussed below, the wheel carriage 450 does not need to be removed from the stairtower 410.

As can be seen in FIGS. 32 and 36, the wheel carriage includes a pivot connection 452, opposed wheels 454, and a slidable connection 456. While the stairtower 410 is resting on the ground or being transported, as will be discussed in detail below, the wheels 454 may extend into the interior of the stairtower 410. This configuration allows the stairtower 410 to be transported with a lower overall height than would otherwise be possible. Thus, the stairtower 410 will be able to clear lower height bridges and overpasses during transportation.

Since the wheels 454 extend into the interior of the stairtower 410, they will likely partially occlude or impede the passage of workers up and down the stairtower 410 if they were to remain in such a position. Therefore, a mechanism and structure that allows the wheels 454 to be moved out of the interior of the stairtower 410 is provided. It will be recognized that devices such as brakes for the wheels and suspension for the wheel carriage may be provided. The brakes may be any suitable braking system such as drum brakes or disk brakes. The braking system may be connected to a tractor trailer or semi-hauler in a known manner. Any suitable suspension system may be utilized, such as leaf springs, hydraulic or pneumatic suspension, coil-over springs, or any other suitable suspension system.

With reference to FIGS. 33 and 36, once the stairtower 410 is erected into a vertical orientation, the entire wheel carriage 450 may pivot away from the stairtower 410 such that the wheels 454 no longer extend into the interior of the stairtower 410. The pivot connection 452 at the proximal ends of the wheel carriage 450 and the stairtower 410 allows the wheel carriage 450 to pivot about that point such that the sliding or slidable connection 456 allows the distal end of the wheel carriage to be space from the stairtower 410.

The pivot connection 452 may be any suitable connection, such as pins, bearings, and flanges, to allow the wheel carriage 450 to pivot thereabout. Of course, the pivot connection 452 may be a removable connection provided by threaded bolts and nuts connecting a flange to the column member. Such a connection further allows the wheel carriage 450 to be connectable to the stairtower 410 at any suitable position along the side of the stairtower 410.

In addition, the slidable connection 456 may incorporate an adjustable or telescoping function, in a recognized manner, to allow the wheels 454 to be oriented at different heights. Thus, the height of the stairtower 410 may be adjusted.

The slidable connection 456 may be any suitable connection that allows the distal end of the wheel carriage 450 to slide or tilt away from the stairtower 410 once the stairtower 410 is placed in a vertical orientation. For example, the slidable connection may be an extending bar or angle bar that lies flat against a lateral member 414 or a platform landing. Such a bar or angle bar may be bolted or clamped to the lateral member 414 or a platform landing in a removable manner.

Thus, once the stairtower 410 has been erected, the bolts or clamps may be removed to allow the bar or angle bar to slide away from the stairtower 410. A suitable retention mechanism, such as a stopping block, may be provided to prevent the extending bar or angle bar from pivoting beyond a defined angle. For example, an additional lateral member may be removably provided across the column members 412 to engage the extending bar or angle bar once a certain pivot angle has been reached. Of course, other suitable mechanisms and structures will be apparent to the skilled artisan.

As more clearly shown in FIG. 36, the wheel carriage 450 spans across adjacent levels, and thus, the wheels 454 are positioned in the stairtower 410 between the levels, and no additional measures need be taken to provide clearance for the wheels to turn. It will be recognized that different sized wheel carriages may be utilized for different sized stairtowers or structures.

Figure 35:
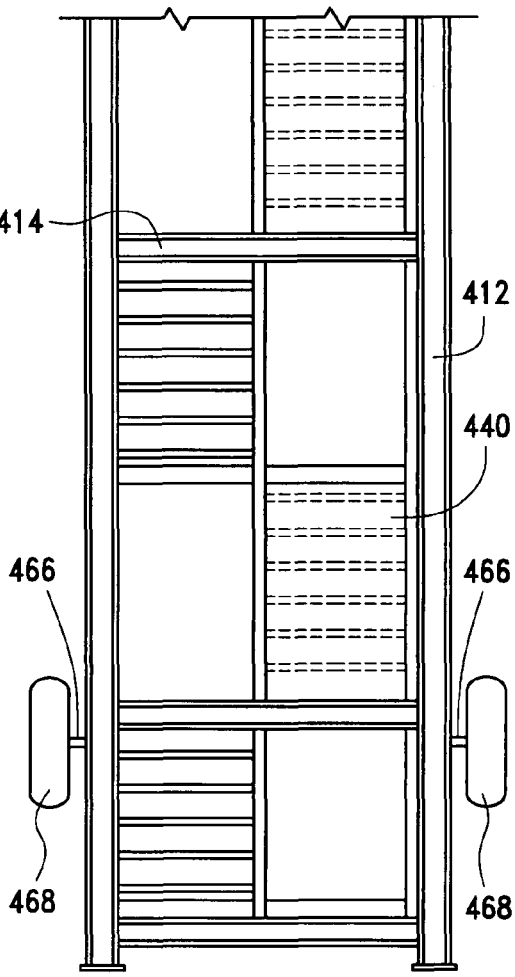
FIG. 35 is a top down view of a variation of the multilevel access stairtower of FIG. 32 having a wheel carriage fixed to the exterior of the stairtower.

In an alternate variation, as shown in FIG. 35, a wheel carriage 466, or an axle, may be provided extending across the stairtower 410 such that wheels 468 mounted on the ends of the wheel carriage 466 are positioned to the exterior of the stairtower 410. Thus, the wheel carriage 466 may be left in position when the stairtower 410 is in a vertical orientation without hindering the worker's passage therethrough. Of course, the wheel carriage 466 may be removably attached in any manner as discussed herein. Further, the wheel carriage 466 may be attached at any suitable position along the side of the stairtower 410. Additionally, the wheel carriage 466 may not be an axle extending across the stairtower 410, but instead the wheels 468 may be attached directly to the exterior of the stairtower 410.

Figure 37:
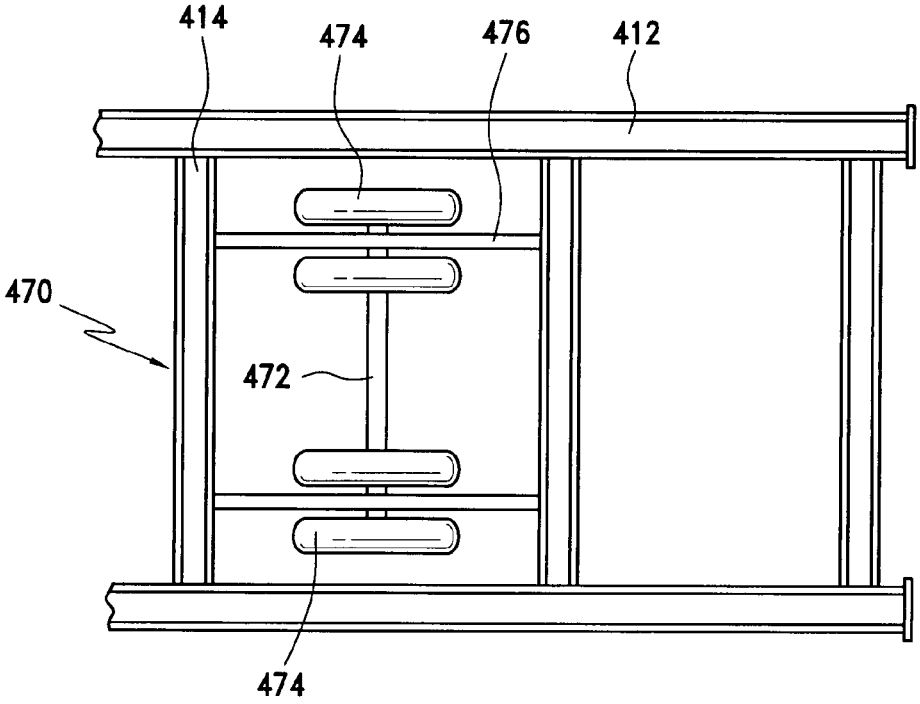
FIG. 37 is a top down view of another variation of the multilevel access stairtower of FIG. 32 having a wheel carriage fixed to the interior of the stairtower.

In yet another variation, as shown in FIG. 37, a wheel carriage 470 may be provided. The wheel carriage 470 includes an axle 472, with wheels 474 attached thereto either fixedly or via bearings, in a manner that will be recognized by a skilled artisan. The wheel carriage includes support beams 476 extending perpendicularly away from the axle 472. The support beams 472 may be bolted or clamped in any known manner to the lateral support members 414. Alternatively, the wheel carriage 470 may be provided with integral lateral members, which are subsequently attached to the column members 412. In either case, the wheel carriage 470 may be removably connected to the stairtower 410 at selected positions along the stairtower 410, such that the wheels 474 do not interfere with the passage of workers therein once the stairtower 410 has been erected to the vertical orientation.

Figure 34:
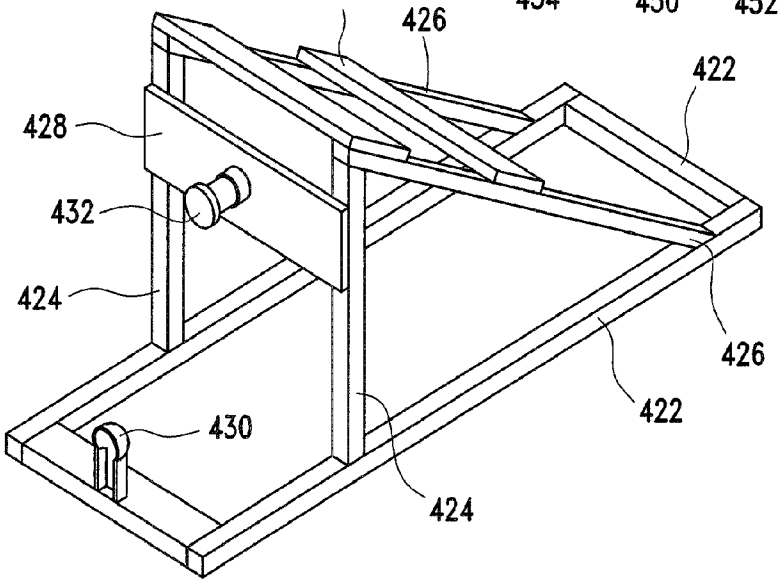
FIG. 34 is a perspective view of the removable transporting and erecting section of the multilevel access stairtower of FIGS. 32 and 33.

In addition to the wheel carriage, in reference to FIGS. 32, 33, and 34, a removable transporting and erecting section 420 is provided to the stairtower 410. The removable transporting and erecting section 420 is removably connected to the stairtower 410 at a distal end thereof to the column members 412 and/or the lateral members 414. The connections may be any suitable bolting, clamping, or other mechanical connections known to a skilled artisan.

Referring to FIG. 34, an exemplary removable transporting and erecting section 420 is shown. The removable transporting and erecting section 420 is composed of opposed lateral members 422 that are arranged and connected to form a frame. A projection 430 for receiving a ball hitch is provided along one of the opposed lateral members 422. The structure of such a projection will be recognized by the skilled artisan, and is not further described herein.

The frame of opposed lateral members 422 also includes opposed projecting members 424 and opposed angle members 426 that extend from the opposed lateral members 422. The opposed projecting members 424 and opposed angle members 426 each form a triangular shape with the opposed lateral members 422. Cross-pieces 428 are provided extending between the opposed triangular shapes formed by the opposed projecting members 424, opposed angle members 426, and opposed lateral members 422.

A pin hitch projection 432, or king pin hitch, is provided extending from the cross-piece 428 that connects the opposed projecting members 424. The structure of such a pin hitch projection will be recognized by the skilled artisan, and is not further described herein.

An additional cross-piece 428, which extends between the opposed angle members 426 acts as a lifting point to erect the stairtower 410 into a vertical orientation, as will be discussed in detail below. Of course, any other suitable lifting point may also be provided or used, such as other cross-pieces or lateral members of the stairtower 410.

Of course, additional cross-bracing or structural members may be added to the removable transporting and erecting section 420 to provide additional support when necessary.

As seen in FIG. 32, a transporting vehicle 498, such as a truck, which has an appropriate ball hitch or pin hitch receiver may be selectively connected to the ball hitch receiver 430 or pin hitch 432, respectively, for transporting the stairtower 410 to a desired location, such as a construction site. The transporting vehicle 498 may be attached to the stairtower 410 in a known manner. Additional cross-bracing or structural members may be added to the stairtower 410 during transportation to provide additional stability, as needed.

Further, appropriate safety devices such as brake light/headlight 446, and turn signal indicators 446, which are removable connected to appropriate locations on the stairtower 410, may be connected to the indicators of the transporting vehicle 498 in a manner that will be recognized by the skilled artisan. Exemplary suitable locations for the brake light/headlight 446, and turn signal indicators 446 may be at the proximal end of the stairtower 410.

Once the transporting vehicle 498 has been connected to the stairtower 410 and the brake light/headlight 446, and turn signal indicators 446 have been appropriately connected, the stairtower 410 may be transported to any desired location. As previously mentioned, the stair segments, and other structural features of the stairtower 410 are removable. Thus, the stairtower 410 may be transported with some, none, or all of the previously described features attached.

As shown in FIG. 33, once the stairtower 410 has been transported to the appropriate site, it may be erected to a vertical orientation. This is accomplished by first detaching the transporting vehicle 498 from the stairtower 410. Next, any brake light/headlight 446, and turn signal indicators 446 are removed from the stairtower 410.

If the stairtower 410 was transported without the staircases or other removable structures, they may be attached to the stairtower 410 at this time. Alternatively, they may be attached to the stairtower 410 once it has been erected to the vertical orientation.

To raise the stairtower 410 from the horizontal orientation to a vertical orientation, a lifting vehicle 460, such as a crane, may be used. If a crane is used, a hook 462 extending from a cable 464 is connected to the lifting point of the cross-piece 428, or other attachment point, and the crane is actuated in a known manner to raise the stairtower 410 to a vertical orientation such that the proximal end of the stairtower 410 rests upon the ground.

At this time, the transporting and erecting section 420 may be disconnected from the stairtower 410 and lifted away from the stairtower 410, such that additional stairtowers may be stacked as modules, as previously described. Further, any removable structures that have not already been connected to the stairtower 410 may be connected at this time. As previously discussed, the wheel carriages and/or the landing gear may also be removed at this time. Further, a support base, as discussed with respect to previous embodiments may be utilized to stabilize the stairtower 410.

As discussed above with previous embodiments, the stairtower 410 may be a temporary structure, or it may be utilized as a permanent internal staircase of a building. If the stairtower 410 is intended as a temporary structure, the steps above for transporting the stairtower 410 may be performed in the reverse order such that the stairtower 410 may be transported away from the site once construction is complete.

The stairtower may also be erected in any other suitable manner, such as the utilization of a hydraulic lifting cylinder. Such a cylinder may be integrally connected between the removable transporting and erecting section and the wheel carriage, or may be separately provided.

Figure 44:
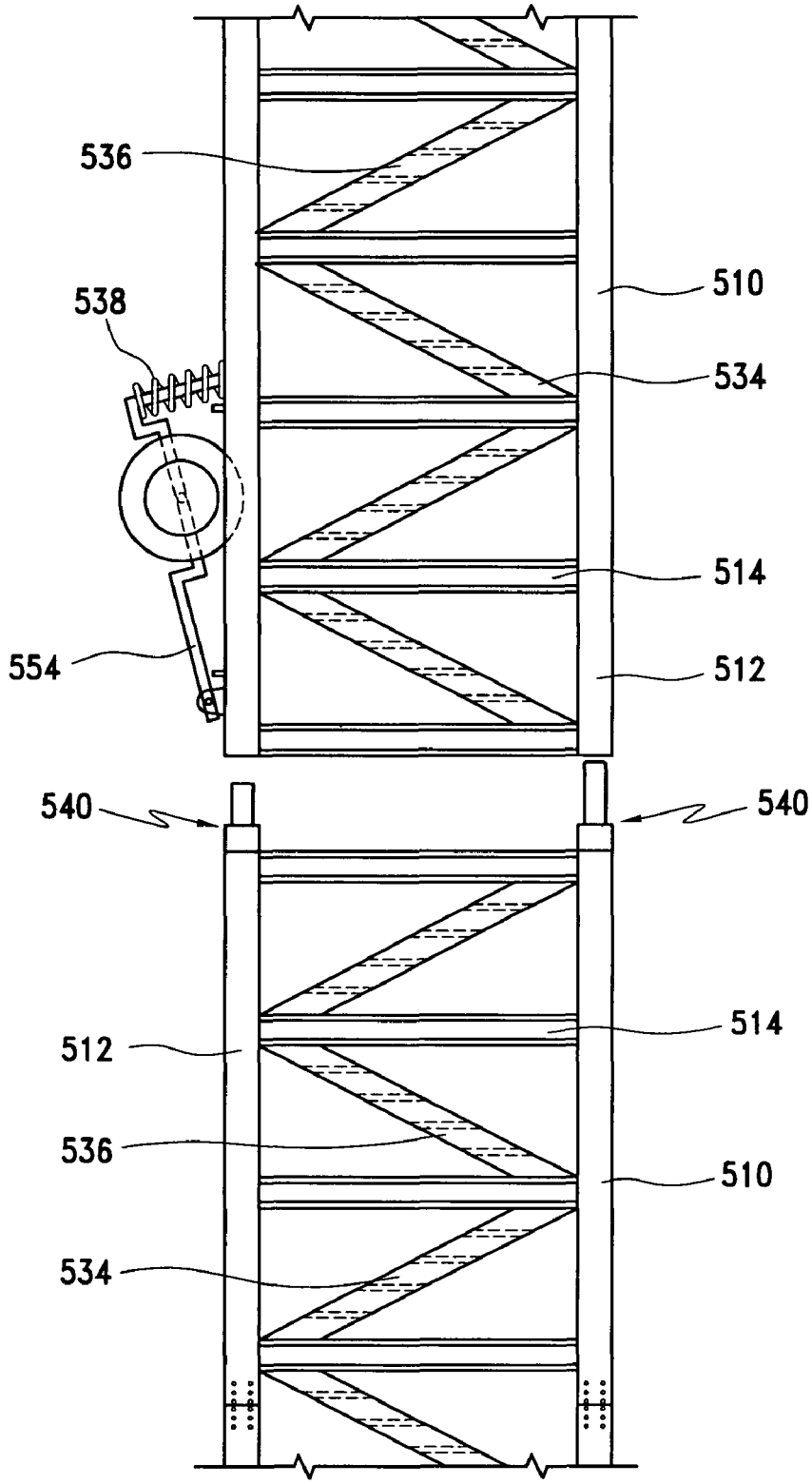
FIG. 44 is a variation of the stairtower disclosed herein and shown in a stackable manner.

In a variation, as illustrated in FIG. 44, stairtowers 510 are shown in a stackable manner. The stairtowers 510 are constructed in a similar manner as described above. Vertical column members 512 and horizontal lateral members 514 are provided to form a transportable and erectable structure, as previously commented upon in detail. The lower stairtower 510 is shown with the external accessories, such as the removable transporting and erecting section, the wheel carriage, the landing gear, and any indicator lights removed. The lower stairtower also includes splice connection members 540 positioned within the distal ends of the column members 512, which may be of box beam construction.

The upper stairtower 510 is shown being lifted into position for stacking upon the lower stairtower. The wheel carriage 554 is shown as being attached and pivoted away from the stairtower 510. An exemplary suspension system 538 is shown as a coil-over spring attached to the distal portion of the wheel carriage. Of course, as previously discussed, any suitable suspension system may be utilized. While the wheel carriage 554 is shown as attached, it will be recognized that the wheel carriage 554 may be removed at any time, including prior to erection of the stairtowers 510.

Another variation of the stairtowers 510 are the fact that the staircases, composed of first 534 and second 536 stair segments extend diagonally across the entire width of the stairtower 510 between the levels of the lateral members 514 and do not include separate landing portions. Thus, the top step of a first stair segment 534 and the adjacent lower step of the second stair segment 536 form the path along which users may travel to ascend or descend the stairtower 510. Such a configuration may be useful to erect and leave in place to form a staircase within a building.

In such a situation, the safety devices previously discussed may be provided for a construction phase only, and may be removed prior to the finalization of the building. Alternatively, the safety devices may not be necessary in such a situation if the building includes a preexisting shaft for a staircase, and the stairtowers are erected directly within the preexisting shaft.

Figure 45:
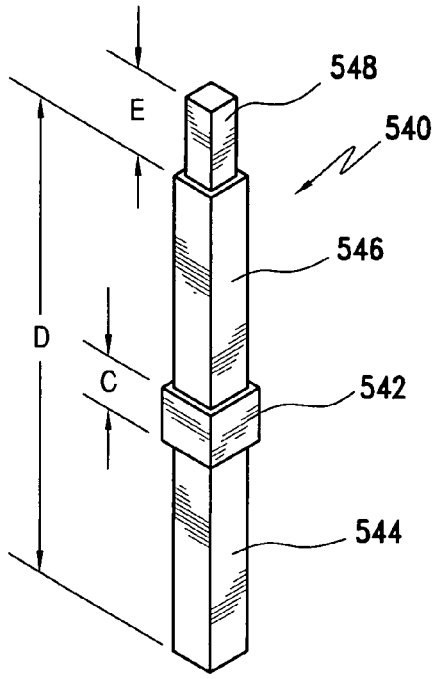
FIG. 45 is a perspective view of a splice connection member for use in stacking stairtowers.

An exemplary splice connection member 540 is more clearly shown in FIG. 45. The splice connection member 540 includes a first extension member 544, a stop member 542, a second extension member 546, and a reinforcement member 548. The splice connection member 540 may be constructed in any suitable manner, such as a solid beam or box beam construction. It is noted that the widths or cross sectional dimensions of the first and second extension members 544, 546 are such that the first and second extension members 544, 546 can be received with a clearance or friction fit within the respective distal and proximal ends of the box beam column members 512 of first and second stairtowers to be stacked together. Of course, the column members may have any other suitable construction.

The width or cross sectional dimension of the stop member 542 is such that the splice connection members cannot be fully received within the ends of the column members 512. Of course, in an alternative embodiment, the width of the stop members may be such that they provide a friction fit within the ends of the column members in order to retain the splice connection members in place. It is noted that the width or cross sectional dimension of the reinforcement member 548 is smaller than the width or cross sectional dimension of the first and second extension members 544, 546 in order to aid with placement of the second stairtower via lowering by crane or other erecting device as previously described.

As further shown in FIG. 45, the exemplary splice connection member 540 has the following lengths. The length C of the stop member 542 is equivalent to the distance between successive steps such that when the first and second stairtowers are stacked together, there is only a distance of one step between them. The overall length D of the stop member 542 and the first and second extension members 544, 546 may vary depending upon the amount of additional support desired, for example where a landing section may be removed. The length E of the reinforcement member 548 may also vary depending upon the amount of additional support desired.

Figure 46:
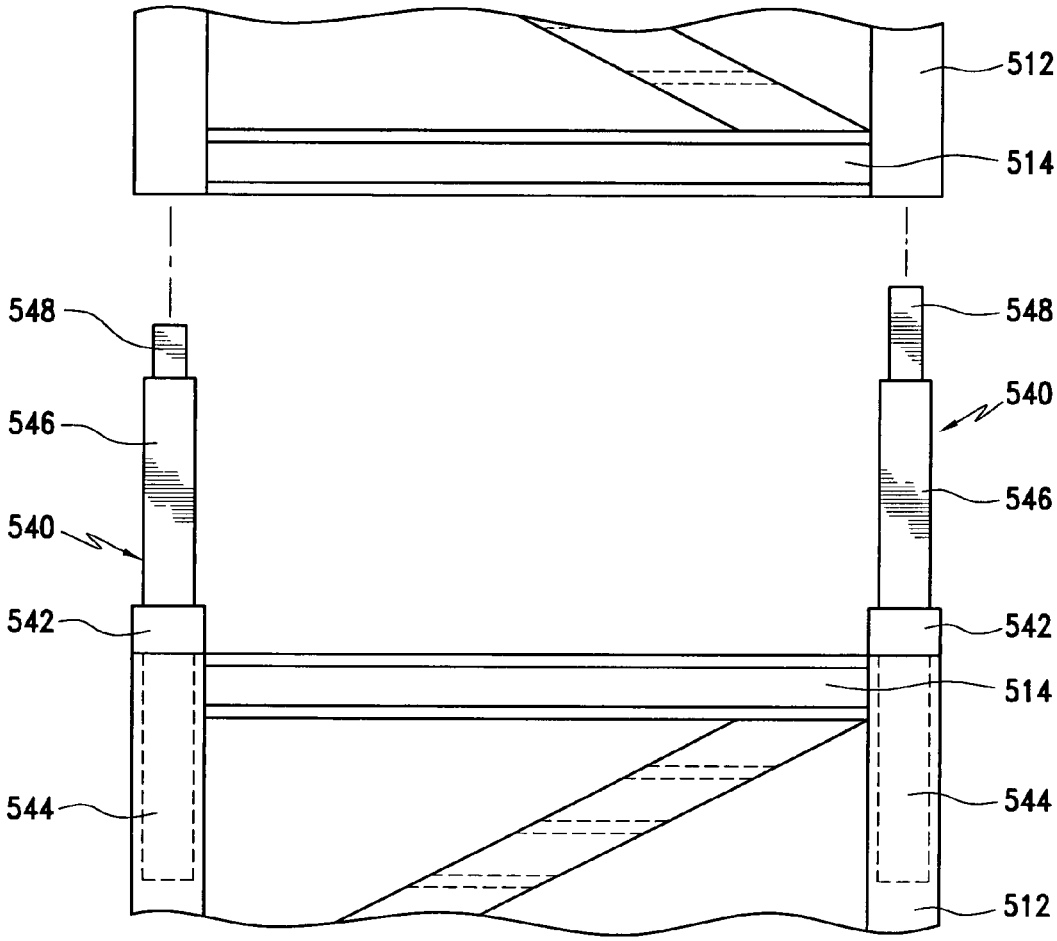
FIG. 46 is a partial plan view of the splice connection member of FIG. 45 being used to stack two stairtowers.

As shown in FIG. 46, the length E of the reinforcement member 548 of the different splice connection members 540 may be varied. Such variation may provide additional support where necessary for example where landings or lateral member portions have been removed. Further, the variation in the height of the reinforcement members 548 provides easier stacking of the first and second stairtowers by allowing the workers assembling the structure to align the stairtowers one column member at a time. For example, each of the four corners of the stairtowers may include a splice connection member 540 with each reinforcement member 548 having a different height.

Many other variations and configurations of the stairtower are contemplated.

E. Conclusion

It is noted that the removable transporting and erecting section and the wheel carriages disclosed herein may be utilized to transport and/or erect any number of structures, such as trailers, platforms, and frames having no stairways.

It will be understood that the modular platform assemblies may be coupled according to conventional techniques for coupling structural members. Conventional techniques include welding and the use of fasteners, and the techniques used may be in accordance with the desired ease of erection and dismantle of the stairtower. Of course, the modular platform assemblies may possess different features, such as those described above.

It will be recognized that the stairtower may be constructed in varying sizes based upon the desired applications and the size of the roads that the stairtower may be transported on. An exemplary size for the width of the staircases is seven feet. Of course, the stairtower is in no way limited to this size.

The skilled artisan will recognize the interchangeability of various features from different embodiments. In addition to the variations described herein, other known equivalents for each feature can be mixed and matched by one of ordinary skill in this art to construct a stairtower in accordance with principles of the present invention.

Although the present invention has been described in considerable detail with reference to certain embodiments thereof, other embodiments are possible. Therefore, the spirit and scope of the appended claims should not be limited to the description of the embodiments contained herein.

The invention claimed is:

1. A transportable and erectable stairtower comprising:

a plurality of elongate and coextensive column members generally parallel to one another and having distal and proximal ends;

a plurality of elongate lateral members extending transversely between, and connected to, the column members to form levels, the levels of the lateral members located at vertically spaced positions relative to the column members, each of the lateral members bordering a side of the stairtower;

a staircase extending between alternating levels of the lateral members;

a wheel carriage arranged for connection to the stairtower along a side thereof;

an installation section removably connected to the distal ends of the column members and arranged for transporting and erecting the stairtower; and wherein the wheel carriage is directly slidably connected to the stairtower at a distal end of the wheel carriage and directly pivotally connected to the stairtower at a proximal end of the wheel carriage such that wheels of the wheel carriage do not block access to an interior of the stairtower when the stairtower is in a vertical orientation.

2. The stairtower according to claim 1, wherein a distal end and a proximal end of the wheel carriage are removably connected to the stairtower.

3. The stairtower according to claim 2, wherein the wheel carriage is removably connectable to the stairtower at selected positions along the side of the stairtower.

4. The stairtower according to claim 1, wherein the installation section comprises:

opposed lateral members forming a frame that is removably connected to the distal ends of the column members;

opposed projecting members and opposed angle members extending from the frame in a triangular shape; and at least one cross-piece extending across the opposed projecting and angle members;

wherein one cross-piece extending across the opposed angle members defines a vertical lift point for lifting the stairtower from a horizontal position to a vertical position.

5. The stairtower according to claim 4, wherein the installation section further comprises:

a projection for receiving a first hitch connected to the frame; and a second hitch extending from one cross-piece extending across the opposed projecting members.

6. The stairtower according to claim 1, wherein the staircase extending between alternating levels of lateral members includes first and second stair segments disposed adjacently in parallel vertical planes, the first stair segment connecting to a first level of lateral members and extending in a first direction to connect to a second stair segment at a second level of lateral members and extending in a second direction towards a third level of lateral members;

wherein each of the first and second stair segments has a first landing portion, a stair portion, and a second landing portion; and each of the first and second stair segments is independently removably attached to the stairtower.

7. The stairtower according to claim 6, wherein the first and second stair segments join at the second level of lateral members to define a platform landing defined by juxtaposed first and second landing portions of the first and second stair segments, respectively.

8. The stairtower according to claim 7, further comprising:

a ramp removably pivotally connected to a column member at select positions above, below, and corresponding with the level of the platform landing, the ramp having;

steps progressing from the platform landing to a base of the ramp; and safety rigging located along opposed sides of the ramp.

9. The stairtower according to claim 7, wherein a portion of the lateral members positioned opposite to the platform landing is removable to define at least one portal to allow passage between the interior and the exterior of the stairtower.

10. The stairtower according to claim 9, further comprising:

a plurality of outriggers positioned about the periphery of each level of lateral members in areas surrounding the at least one portal.

11. The stairtower according to claim 6, wherein the first landing portion, the stair portion, and the second landing portion of each stair segment have perforations to allow debris and rainwater to pass therethrough; and catch pan segments are connected to proximal portions of the first landing portion, the stair portion, and the second landing portion of each stair segment to collect and transport the debris and rainwater to gutters connected to the catch pan segments, which gutters transport the debris and rainwater to downspouts attached to the stairtower.

12. The stairtower according to claim 1, wherein at least two stairtowers are stacked with a first stairtower having a second stairtower removably connected thereto via at least one splice connection member;

the at least one splice connection member being positioned within a distal end of one of the column members of the first stairtower and within the proximal end of a corresponding column member of the second stairtower.

13. The stairtower according to claim 1, further comprising: a platform base assembly connected at a proximal base portion of the stairtower, the base assembly including a housing supporting a plurality of support beams each extensible relative to the housing and having an anchor device at a first end thereof arranged to extend outwardly from the housing.

14. The stairtower according to claim 1, further comprising:

a suspension system for use with the wheel carriage; and brake, headlight, and turn signal indicators connected at suitable locations on the stairtower.

15. A transportable and erectable stairtower comprising:

a plurality of elongate and coextensive column members generally parallel to each other and having distal and proximal ends;

a plurality of elongate and coextensive lateral members extending transversely between, and connected to, the column members to form levels, the levels of the lateral members located at vertically spaced positions relative to the column members, each of the lateral members bordering a side of the stairtower;

a staircase having first and second stair segments and extending between alternating levels of the lateral members;

wherein each of the first and second stair segments has a first landing portion, a stair portion, and a second landing portion;

wherein the first landing portion, the stair portion, and the second landing portion of each stair segment have perforations to allow for debris and rainwater to pass therethrough; gutters, which are connected to downspouts; and wherein catch pan segments are connected to proximal portions of the first landing portion, the stair portion, and the second landing portion of each stair segment to collect and transport the debris and rainwater to the gutters connected to the catch pan segments, which gutters transport the debris and rainwater to the downspouts attached to the column members.

16. The stairtower according to claim 15, further comprising:

a wheel carriage arranged for slidable and removable connection along a side of the stairtower; and an installation section removably connected to the distal ends of the column members for transporting and erecting the stairtower and having:

a first hitch receiving projection attached to a frame defined by opposed lateral members;

a second hitch attached to a first cross-piece connected to a triangular frame extending from the opposed lateral members;

and a vertical lifting point formed at a second cross-piece connected to the triangular frame for lifting the stairtower from a horizontal position to a vertical position.

17. A transportable and erectable stairtower having four corners and comprising:

a plurality of elongate and coextensive column members generally parallel to one another and having distal and proximal ends;

a plurality of elongate lateral members extending transversely between, and connected to, the column members to form levels, the levels of the lateral members located at vertically spaced positions relative to the column members, each of the lateral members bordering a side of the stairtower;

a staircase extending between alternating levels of the lateral members;

a wheel carriage arranged for connection to the stairtower along a side thereof;

wherein the wheel carriage is directly slidably connected to the stairtower at a distal end of the wheel carriage and directly pivotally connected to the stairtower at a proximal end of the wheel carriage such that the wheels of the wheel carriage do not block access to an interior of the stairtower when the stairtower is in a vertical orientation; an installation section removably connected to the distal ends of the column members and arranged for transporting and erecting the stairtower;

wherein the installation section comprises:

opposed lateral members forming a frame that is removably connected to the distal ends of the column members at the four corners of the stairtower;

opposed projecting members projecting from the frame between the four corners of the stairtower and opposed angle members extending from the frame between the four corners of the stairtower and connected to the opposed projecting members in a triangular shape; and at least one cross-piece extending across the opposed projecting and angle members;

wherein, one cross-piece extending across the opposed angle members defines a vertical lift point for lifting the stairtower from a horizontal position to a vertical position.

18. The stairtower according to claim 17, wherein the installation section further comprises:

a projection for receiving a first hitch connected to the frame; and a second hitch extending from one cross-piece extending across the opposed projecting members.

* * * * *